US010503107B2

(12) United States Patent
Hara et al.

(10) Patent No.: US 10,503,107 B2
(45) Date of Patent: Dec. 10, 2019

(54) IMAGE FORMING APPARATUS CONTROLLING TRANSFER POWER SOURCE BASED ON DETECTION RESULT OF DETECTION UNIT CONNECTED TO TRANSFER PORTION

(71) Applicant: CANON KABUSHIKI KAISHA, Tokyo (JP)

(72) Inventors: Jun Hara, Kawasaki (JP); Kenichi Iida, Tokyo (JP); Shimpei Ishikawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/829,455

(22) Filed: Dec. 1, 2017

(65) Prior Publication Data

US 2018/0173142 A1 Jun. 21, 2018

(30) Foreign Application Priority Data

Dec. 15, 2016 (JP) ..... 2016-243807
Dec. 26, 2016 (JP) ..... 2016-251836

(51) Int. Cl.

| | |
|---|---|
| ***G03G 15/00*** | (2006.01) |
| ***G03G 15/16*** | (2006.01) |
| ***G03G 15/20*** | (2006.01) |
| ***G03G 21/20*** | (2006.01) |
| ***G03G 15/01*** | (2006.01) |

(52) U.S. Cl.

CPC ..... *G03G 15/5004* (2013.01); *G03G 15/16* (2013.01); *G03G 15/1675* (2013.01); *G03G 15/2039* (2013.01); *G03G 15/0131* (2013.01); *G03G 15/1645* (2013.01); *G03G 21/20* (2013.01); *G03G 21/203* (2013.01); *G03G 2215/2035* (2013.01)

(58) Field of Classification Search

CPC ..... G03G 15/5004; G03G 15/16; G03G 15/1675; G03G 15/0131; G03G 15/1645; G03G 21/20; G03G 21/203

See application file for complete search history.

(56) References Cited

U.S. PATENT DOCUMENTS 6,111,594 A * 8/2000 Jeong ..... G03G 15/1675 347/140
6,157,804 A * 12/2000 Richmond ..... G03G 15/16 310/311
2017/0160681 A1* 6/2017 Hiroi ..... G03G 15/1665

FOREIGN PATENT DOCUMENTS

| | | | |
|---|---|---|---|
| JP | 2006-195003 | A | 7/2006 |
| JP | 2011-215538 | A | 10/2011 |
| JP | 2015-084084 | A | 4/2015 |

* cited by examiner

*Primary Examiner* — Joseph S Wong
(74) *Attorney, Agent, or Firm* — Canon U.S.A., Inc. IP Division

(57) ABSTRACT

A heating member of a fixing unit is situated in a fixing portion, and a commercial power source applies an alternating-current voltage to the heating member so that the heating member heats a transfer medium held in the fixing portion. In a case of transferring the toner image from an image bearing member onto the transfer medium in a transfer portion, a control unit controls a transfer power source based on a result of a comparison between a frequency obtained from a first detection result input from a detection unit with a predetermined frequency range including the frequency of the alternating-current voltage.

30 Claims, 16 Drawing Sheets

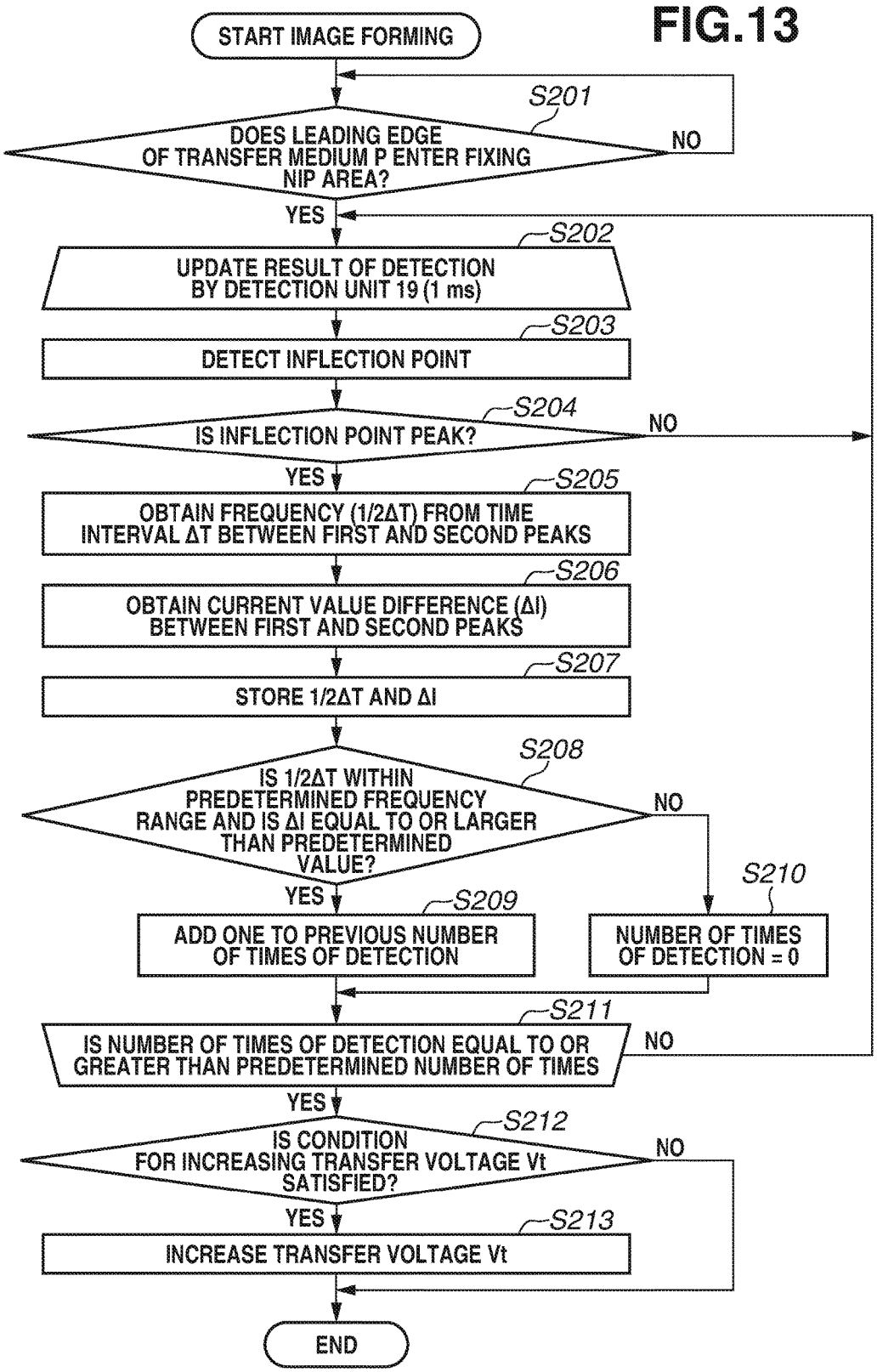
FIG.13
START IMAGE FORMING
S201
DOES LEADING EDGE OF TRANSFER MEDIUM P ENTER FIXING NIP AREA?
NO
YES
S202
UPDATE RESULT OF DETECTION BY DETECTION UNIT 19 (1 ms)
S203
DETECT INFLECTION POINT
S204
IS INFLECTION POINT PEAK?
NO
YES
S205
OBTAIN FREQUENCY (1/2ΔT) FROM TIME INTERVAL ΔT BETWEEN FIRST AND SECOND PEAKS
S206
OBTAIN CURRENT VALUE DIFFERENCE (ΔI) BETWEEN FIRST AND SECOND PEAKS
S207
STORE 1/2ΔT AND ΔI
S208
IS 1/2ΔT WITHIN PREDETERMINED FREQUENCY RANGE AND IS ΔI EQUAL TO OR LARGER THAN PREDETERMINED VALUE?
NO
YES
S209
ADD ONE TO PREVIOUS NUMBER OF TIMES OF DETECTION
S210
NUMBER OF TIMES OF DETECTION = 0
S211
IS NUMBER OF TIMES OF DETECTION EQUAL TO OR GREATER THAN PREDETERMINED NUMBER OF TIMES
NO
YES
S212
IS CONDITION FOR INCREASING TRANSFER VOLTAGE Vt SATISFIED?
NO
YES
S213
INCREASE TRANSFER VOLTAGE Vt
END

IMAGE FORMING APPARATUS CONTROLLING TRANSFER POWER SOURCE BASED ON DETECTION RESULT OF DETECTION UNIT CONNECTED TO TRANSFER PORTION

BACKGROUND

Field of the Disclosure

The present disclosure relates to electrophotographic image forming apparatuses, such as copying machines and printers.

Description of the Related Art

In an electrophotographic image forming apparatus, a transfer voltage is applied to a transfer member situated to face an image bearing member, such as a drum-shaped photosensitive member or intermediate transfer member, to electrostatically transfer a toner image borne on the image bearing member onto a transfer medium, such as a sheet or overhead projector (OHP) sheet. Thereafter, the transfer medium onto which the toner image is transferred at a transfer nip portion formed by the image bearing member and the transfer member is conveyed to a fixing unit and then heated and pressed by the fixing unit so that the toner image is fixed to the transfer medium. The fixing unit includes a heating member, such as a heater, and a pressing member which is pressed against the heating member to form a fixing nip portion. An alternating-current (AC) power source applies an AC voltage to the heating member so that the heating member is heated to a temperature at which the toner image is transferable onto the transfer medium.

In such an image forming apparatus, use of a transfer medium which has been left under a high-temperature, high-humidity environment or the like for a long period of time and consequently has absorbed moisture and has a decreased electric resistance can cause the following image defect. If the transfer medium is held at the transfer nip portion while the toner image is transferred, the AC voltage is superimposed on the transfer voltage via the transfer medium at the transfer nip portion and thus changes the transfer voltage at the transfer nip portion. This causes a current flowing from the transfer member toward the image bearing member to be deflected by a waveform component of the AC voltage, which results in non-uniform transferability. Consequently, a defective image is formed with non-uniform shades in a sub-scanning direction of the image (hereinafter, this defect is referred to as "AC banding").

Japanese Patent Application Laid-Open No. 2011-215538 discusses an arrangement in which a detection member is provided to detect a current flowing in a transfer member and if the value of deflection of the current detected by the detection member while a toner image is transferred onto a transfer medium is larger than a predetermined value, it is determined that AC banding occurs, and a transfer voltage is controlled.

In the arrangement discussed in Japanese Patent Application Laid-Open No. 2011-215538, however, unintended change to the transfer voltage can be occurred also when the current flowing in the transfer member exceeds the predetermined value due to a cause other than the waveform component of AC voltage (hereinafter, "AC waveform component"). This change to the transfer voltage when no change to the transfer voltage is needed can end up causing an image defect.

SUMMARY

The present disclosure is directed to an image forming apparatus capable of accurately detecting a superimposition of an alternating-current (AC) voltage on a transfer voltage via a transfer medium to prevent image defects.

According to an aspect of the present disclosure, an image forming apparatus includes an image bearing member configured to bear a toner image, a transfer member configured to be brought into contact with the image bearing member to form a transfer portion and transfer the toner image from the image bearing member onto a transfer medium in the transfer portion, a transfer power source configured to apply a voltage to the transfer member, a fixing unit situated downstream of the transfer portion in a direction in which the transfer medium is conveyed, the fixing unit including a heating member and a pressing member configured to be brought into contact with the heating member to form the fixing portion, wherein the heating member includes a heating unit situated to face the transfer medium held in the fixing portion and a voltage is applied from an alternating-current power source to the heating unit so that the heating unit heats the transfer medium held in the fixing portion, a first detection unit situated between the transfer member and the transfer power source and configured to detect a current flowing in the transfer member, and a control unit configured to control the transfer power source based on a first detection result input from the first detection unit, wherein in a case of transferring the toner image from the image bearing member onto the transfer medium in the transfer portion, the control unit controls the transfer power source based on a result of a comparison between a frequency obtained from the first detection result and a predetermined frequency range including a frequency of the alternating-current power source.

Further features of the present disclosure will become apparent from the following description of exemplary embodiments with reference to the attached drawings.

BRIEF DESCRIPTION OF THE DRAWINGS

FIG. 13 is a flow chart illustrating the setting of an appropriate transfer voltage according to the third exemplary embodiment of the subject disclosure.

DESCRIPTION OF THE EMBODIMENTS

Various exemplary embodiments of the present disclosure will be described below with reference to the attached drawings. It should be noted that the dimensions, materials, shapes, relative locations, etc. of components described below are to be changed as needed according to various conditions and the structure of an apparatus to which an exemplary embodiment of the present disclosure is applied. Thus, unless otherwise specified, the description below is not intended to limit the scope of the disclosure.

[Structure of Image Forming Apparatus]

Figure 1:
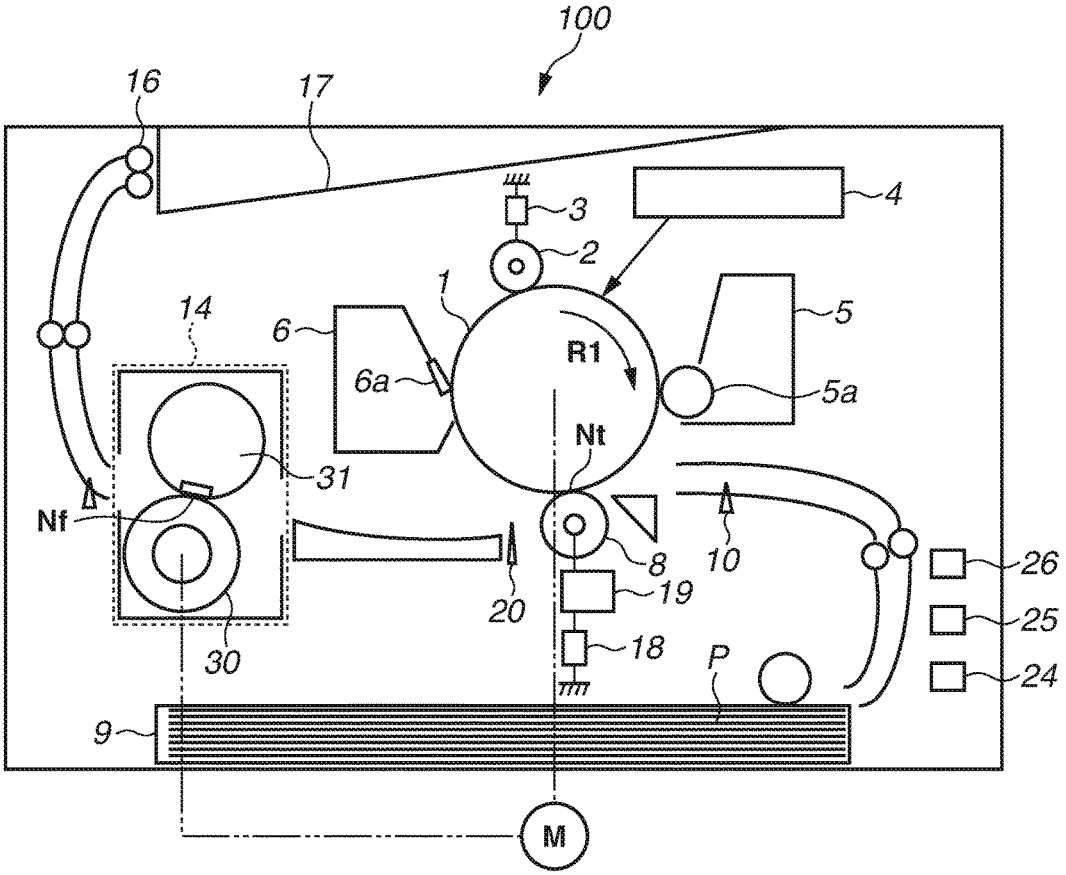
FIG. 1 is a cross sectional view schematically illustrating an image forming apparatus according to a first exemplary embodiment of the subject disclosure.
Figure 2:
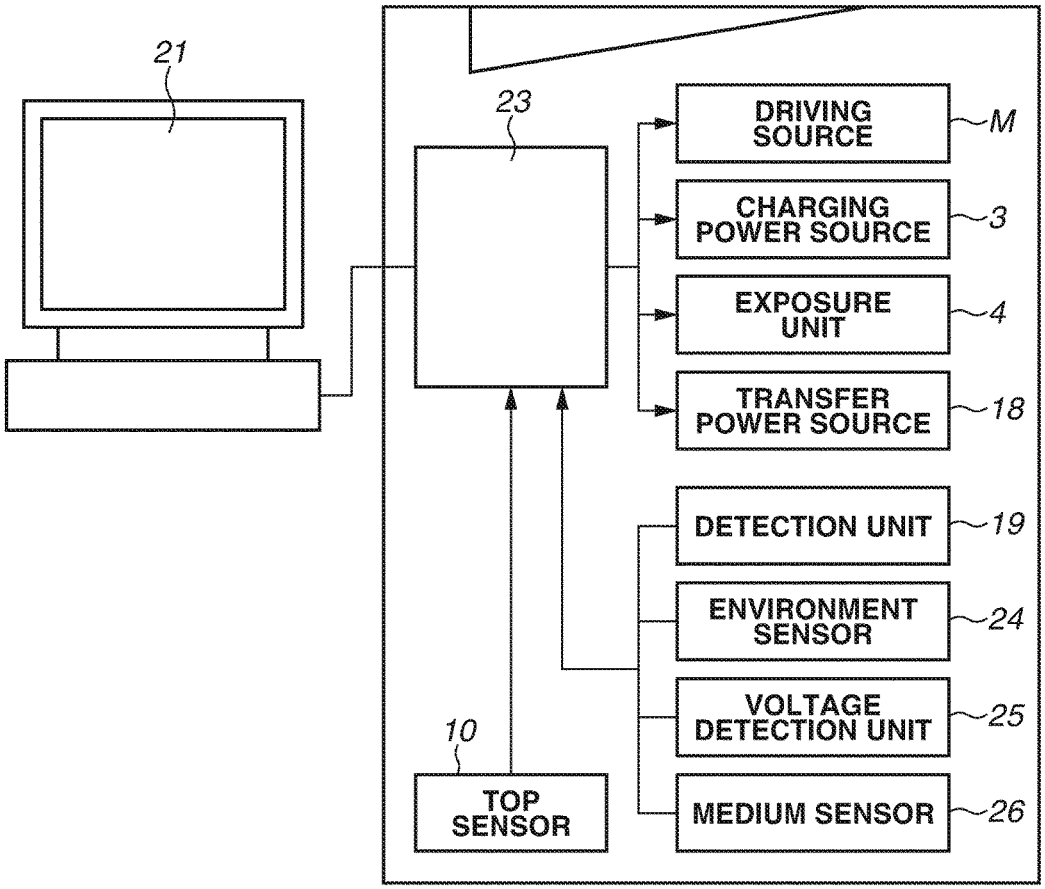
FIG. 2 is a block diagram according to the first exemplary embodiment of the subject disclosure.

FIG. 1 is a cross sectional view schematically illustrating an image forming apparatus 100 according to an exemplary embodiment of the present disclosure. FIG. 2 is a block diagram illustrating a control system of the image forming apparatus 100 according to the present exemplary embodiment. As illustrated in FIG. 2, the image forming apparatus 100 is connected to a personal computer 21 which is a host device. Operation start instructions and image signals from the personal computer 21 are transmitted to a controller circuit 23 which is a built-in control unit of the image forming apparatus 100. The controller circuit 23 controls various units to execute image forming in the image forming apparatus 100. The controller circuit 23 is capable of controlling various units based on detection results input from various control units and information input to the image forming apparatus 100 by a user.

As illustrated in FIG. 1, the image forming apparatus 100 according to the present exemplary embodiment includes a photosensitive drum 1 (image bearing member) which is a drum-shaped photosensitive member. The photosensitive drum 1 receives a driving force from a driving source M to be driven and rotated in the direction of an arrow R1 specified in FIG. 1 at a predetermined circumferential speed. The photosensitive drum 1 in the present exemplary embodiment has an outside diameter of 24 mm and is driven and rotated at a circumferential speed of 118 mm/seconds.

Around the photosensitive drum 1 are situated a charging roller 2, a charging power source 3, an exposure unit 4, a development unit 5, and a cleaning unit 6. The development unit 5 includes a development roller 5*a* which is a development member. The cleaning unit 6 includes a cleaning blade 6*a*. The charging power source 3 applies a voltage to the charging roller 2. Toner is stored in the development unit 5, and a development power source (not illustrated) applies a voltage of the opposite polarity to the normal charging polarity of the toner so that the development roller 5*a* can bear the toner stored in the development unit 5.

Further, a transfer roller 8 is situated to face the photosensitive drum 1. The transfer roller 8 is a transfer member which is abutted against the photosensitive drum 1 to form a transfer nip portion Nt (transfer portion). The transfer roller 8 includes a metal core and an elastic member, such as rubber, which is conductive and formed on the surface of the metal core. In the present exemplary embodiment, the metal core has an outside diameter of 5 mm, the elastic member has a thickness of 3.75 mm, and the electric resistance value of the transfer roller 8 is adjusted to $10^7\Omega$ to $10^9\Omega$. Further, the transfer roller 8 is connected to a transfer power source 18, and between the transfer roller 8 and the transfer power source 18 is provided a detection unit 19 (first detection unit) which detects a current flowing toward the transfer roller 8.

A fixing unit 14 including a pressing member 30 and a heating member 31 is provided downstream of a transfer nip portion Nt in the direction in which a transfer medium P is conveyed. Further, the image forming apparatus 100 includes a sheet feeding cassette 9 and a sheet discharge tray 17. The sheet feeding cassette 9 is a storage unit for storing the transfer mediums P such as sheets and overhead projector (OHP) sheets. The sheet discharge tray 17 is a stacking unit for stacking the transfer mediums P on which an image is formed and which are discharged from the image forming apparatus 100.

Further, as illustrated in FIG. 1, the image forming apparatus 100 includes a top sensor 10, an environment sensor 24 (second detection unit), a voltage detection unit 25 (third detection unit), and a medium sensor 26 (fourth detection unit). The top sensor 10 is capable of detecting the leading edge of the transfer medium P fed from the sheet feeding cassette 9 in the direction in which the transfer medium P is conveyed. The medium sensor 26 is capable of judging the type of the transfer medium P fed from the sheet feeding cassette 9. Further, the environment sensor 24 is capable of detecting the temperature and humidity of an environment around the image forming apparatus 100. The voltage detection unit 25 is capable of detecting the voltage of a commercial power source connected to the image forming apparatus 100. As illustrated in FIG. 2, results of detection by the above-described various detection units are input to the controller circuit 23.

An image forming operation is started in response to the reception of an image signal by the controller circuit 23 (illustrated in FIG. 2), and the photosensitive drum 1 is driven and rotated. During the rotation, the photosensitive drum 1 is uniformly charged to a predetermined potential by the charging roller 2 to which a voltage of predetermined polarity (which is negative in the present exemplary embodiment) is applied by the charging power source 3. Thereafter, the photosensitive drum 1 is exposed by the exposure unit 4 based on the image signal so that an electrostatic latent image corresponding to a target image is formed on the surface of the photosensitive drum 1. The electrostatic latent image is developed by the development roller 5*a* bearing the toner in a development position and visualized as a toner image on the photosensitive drum 1. In the present exemplary embodiment, the normal charging polarity of the toner stored in the development unit 5 is negative, and the electrostatic latent image is developed by reversal development with the toner charged to the same polarity as the charging polarity of the photosensitive drum 1 by the charging roller 2. Applications of an exemplary embodiment of the present disclosure are not limited to the above-described application, and an exemplary embodiment of the present disclosure is also applicable to an image forming apparatus in which an electrostatic latent image is developed by positive development with toner charged to the opposite polarity to the charging polarity of the photosensitive drum 1.

A voltage of the opposite polarity (which is positive in the present exemplary embodiment) to the normal charging polarity of the toner is applied from the transfer power source 18 to the transfer roller 8 so that the toner image formed on the photosensitive drum 1 is transferred in the transfer nip portion Nt onto the transfer medium P fed from the sheet feeding cassette 9. After the leading edge of the transfer medium P conveyed to the transfer nip portion Nt is detected by the top sensor 10 provided upstream of the transfer nip portion Nt in the direction in which the transfer medium P is conveyed, the transfer medium P is held in the transfer nip portion Nt, and the toner image is transferred from the photosensitive drum 1 onto the transfer medium P. The transfer roller 8 is biased toward the photosensitive drum 1 by a biasing unit (not illustrated), and when the toner image is transferred from the photosensitive drum 1 onto the transfer medium P, the transfer roller 8 is rotated by the rotation of the photosensitive drum 1.

The electric resistance value of the transfer roller 8 changes based on the temperature and humidity of the surrounding environment, durability of the transfer roller 8, etc. Thus, the voltage to be applied from the transfer power source 18 to the transfer roller 8 needs to be determined based on the change in the electric resistance value of the transfer roller 8 when a toner image is transferred from the photosensitive drum 1 onto the transfer medium P. The voltage (hereinafter, "transfer voltage Vt") to be applied from the transfer power source 18 to the transfer roller 8 at the time of transferring a toner image from the photosensitive drum 1 onto the transfer medium P is determined by active transfer voltage control (ATVC). The following describes ATVC.

First, constant current control is performed so that a current of a predetermined value flows in the transfer roller 8 before the transfer medium P reaches the transfer nip portion Nt, and from the value of voltage V0 applied at this time from the transfer power source 18 to the transfer roller 8, the electric resistance value of the transfer roller 8 is calculated. The current flowing in the transfer roller 8 is detected by the detection unit 19, and the controller circuit 23 controls the transfer power source 18 based on a detection result input from the detection unit 19. In this way, the constant current control is performed. Then, the controller circuit 23 refers to a look-up table (LUT) recorded in advance in a built-in memory to determine the transfer voltage Vt (first voltage) based on the calculated electric resistance value of the transfer roller 8 and the value of the voltage V0. Thereafter, the controller circuit 23 feeds back the determined transfer voltage Vt to the transfer power source 18, and the transfer power source 18 applies the transfer voltage Vt to the transfer roller 8 so that the toner image is transferred onto the transfer medium P in the transfer nip portion Nt.

In the present exemplary embodiment, the controller circuit 23 controls the transfer power source 18 such that a constant current flows from the transfer roller 8 toward the photosensitive drum 1 when a toner image is transferred from the photosensitive drum 1 onto the transfer medium P. In this process, the controller circuit 23 controls the transfer power source 18 based on the current value detected by the detection unit 19 to perform constant current control. Performing such constant current control, however, can cause an issue described below when a toner image is transferred onto the transfer medium P having a low electric resistance in the transfer nip portion Nt.

When a toner image is transferred from the photosensitive drum 1 onto the transfer medium P that has a decreased electric resistance as a result of absorbing moisture, etc., if the constant current control is performed, the controller circuit 23 performs control to reduce the voltage to be applied from the transfer power source 18 to the transfer roller 8 because the electric resistance of the transfer medium P is low. However, the current flowing from the transfer roller 8 to the photosensitive drum 1 leaks to the members that are in contact with the transfer medium P through the transfer medium P having a decreased electric resistance, so in this process, the current for transferring the toner image from the photosensitive drum 1 onto the transfer medium P in the transfer nip portion Nt can become insufficient. This can cause transfer failure.

Thus, in the present exemplary embodiment, a lower limit voltage Vt1 is set with respect to the transfer voltage Vt which is applied from the transfer power source 18 to the transfer roller 8. The lower limit voltage Vt1 is set to prevent a shortage of current flowing from the transfer roller 8 to the photosensitive drum 1 in the transfer nip portion Nt. Specifically, in the present exemplary embodiment, if the absolute value of the transfer voltage Vt is larger than the lower limit voltage Vt1, the controller circuit 23 performs constant current control, and if the transfer voltage Vt becomes equal to the lower limit voltage Vt1, the controller circuit 23 performs constant voltage control to control the transfer power source 18. When the constant voltage control is performed, the lower limit voltage Vt1 is applied from the transfer power source 18 to the transfer roller 8. While the lower limit voltage Vt1 is set by a calculation formula using the voltage V0 obtained when ATVC is performed in the present exemplary embodiment, the setting is not limited to the above-described setting, and the lower limit voltage Vt1 can be set by referring to the LUT based on the value of the voltage V0 as in the case of the transfer voltage Vt.

The transfer medium P onto which the toner image is transferred in the transfer nip portion Nt is conveyed to the fixing unit 14 after charges accumulated on the surface of the transfer medium P are neutralized by a neutralization member 20. Then, the transfer medium P is heated by the heating member 31 and pressed by the pressing member 30 in the fixing unit 14 so that the toner image is fixed to the transfer medium P. The toner (residual untransferred toner) that remains on the surface of the photosensitive drum 1 after the toner image is transferred onto the transfer medium P is cleaned and removed by the cleaning blade **6*a* and collected into the cleaning unit 6. The transfer medium P to which the toner image is fixed in the fixing unit 14 is discharged to the sheet discharge tray 17 by a pair of sheet discharge rollers 16. The image forming apparatus 100** according to the present exemplary embodiment performs the above-described operations to form an image on the transfer medium P.

[Fixing Unit]

Figure 3:
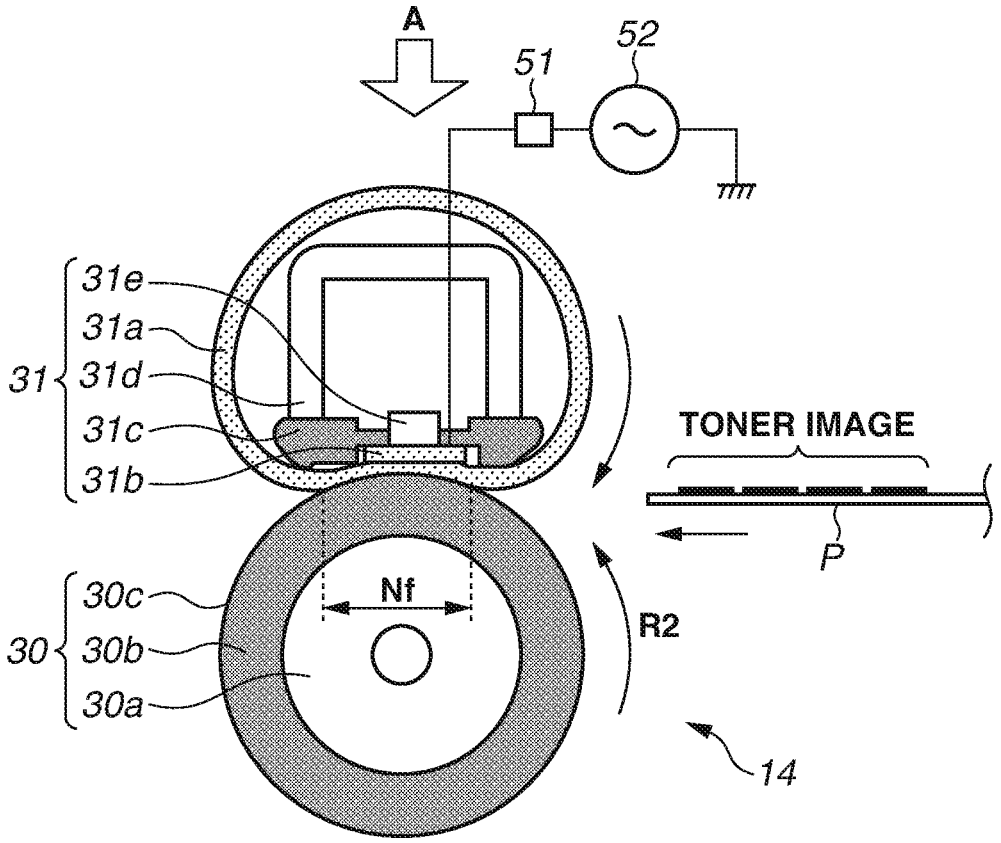
FIG. 3 is a cross sectional view schematically illustrating the structure of a fixing unit according to the first exemplary embodiment of the subject disclosure.

The present exemplary embodiment employs a fixing unit of a film fixing method. FIG. 3 is a cross sectional view schematically illustrating the structure of the fixing unit 14 in the present exemplary embodiment. As illustrated in FIG. 3, the fixing unit 14 includes the pressing member 30 and the heating member 31, and the pressing member 30. The pressing member 30 presses the heating member 31 to form a fixing nip portion Nf. The fixing nip portion Nf is a fixing portion capable of holding the transfer medium P having a transferred toner image.

The pressing member 30 is a roller having an outside diameter of 14 mm and including a metal core 30*a*, an elastic layer 30*b*, and a release layer 30*c*. The elastic layer 30*b* is formed on the outer periphery of the metal core 30*a*. The release layer 30*c* is formed on the outer periphery of the elastic layer 30*b*. Silicone rubber, fluoro-rubber, etc. can be used as the elastic layer 30*b*, and a fluoro-resin, such as a tetrafluoroethylene-perfluoro alkyl vinyl ether copolymer (PFA), etc. can be used as the release layer 30*c*. The pressing member 30 is rotatably supported at respective ends of the metal core 30*a* in the lengthwise direction.

The heating member 31 includes a film 31*a*, a heater 31*b*, a support portion 31*c*, and a pressing stay 31*d*. The heater 31*b* is in the shape of a plate and situated to face the pressing member 30 via the film 31*a* and be in contact with the inner periphery of the film 31*a*. The support portion 31*c* supports the heater 31*b*. The pressing stay 31*d* stiffens the support portion 31*c*. The heater 31*b* which is a heating unit is situated in the fixing nip portion Nf, and an alternating-current voltage is applied to the heater 31*b* from a commercial power source 52 (alternating-current power source) through a bidirectional thyristor 51 (triode for alternating current (TRIAC)). The controller circuit 23 controls the current flowing to a gate of the bidirectional thyristor 51 to turn on/off the bidirectional thyristor 51, and the alternating-current voltage to be applied to the alternating-current voltage heater 31*b* is controlled to adjust the temperature of the heater 31*b*.

The film 31*a* is a roll-shaped flexible member including a substrate layer (not illustrated), an elastic layer (not illustrated), and a release layer (not illustrated). The elastic layer is formed on the outer periphery of the substrate layer. The release layer is formed on the outer periphery of the elastic layer. The substrate layer of the film 31*a* needs to be resistant to heat to receive heat from the heater 31*b* and needs to have durability to rub against the heater 31*b*, so a metal, such as stainless steel or nickel, or a heat-resistant resin, such as polyimide, is desirably used as the substrate layer of the film 31*a*. Further, a fluoro-resin, such as perfluoroalcoxy resin (PFA) or polytetrafluoroethylene resin (PTFE), is desirably used as the release layer of the film 31*a*. The film 31*a* in the present exemplary embodiment has an outside diameter of 18 mm. Polyimide with a thickness of about 60 μm is used as the substrate layer of the film 31*a*. Silicon rubber with a thickness of about 150 μm is used as the elastic layer of the film 31*a*. Further, PFA which is excellent in releasability and heat-resistance among fluoro-resins is used as the release layer, and the thickness of the release layer is set to 10 μm.

Figure 4A:
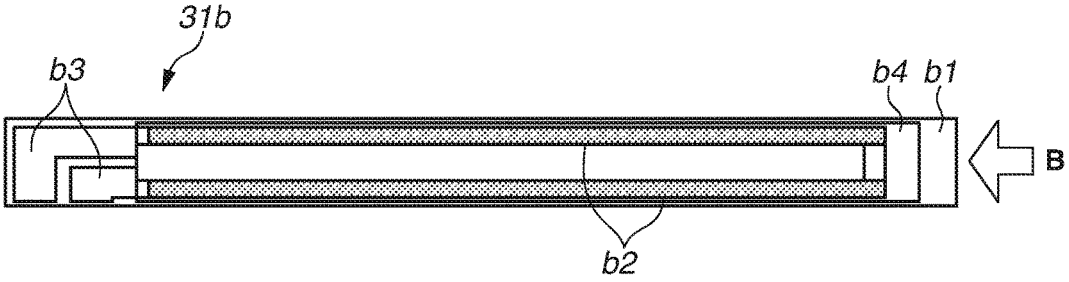
FIGS. 4A and 4B are schematic views illustrating a heating unit according to the first exemplary embodiment of the subject disclosure.
Figure 4B:
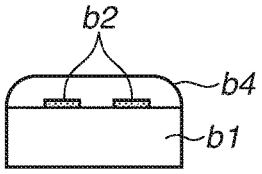

FIG. 4A is a schematic view illustrating the structure of the heater 31*b* viewed from the direction of an arrow A specified in FIG. 3. FIG. 4B is a schematic view illustrating the structure of the heater 31*b* viewed from the direction of an arrow B specified in FIG. 4A. As illustrated in FIG. 4A, the heater 31*b* includes a substrate b1 of alumina and a heat generation resistor b2 of a silver-palladium alloy. The substrate b1 has a thickness of 1 mm in the thickness direction and a width of 6 mm in the direction in which the transfer medium P is conveyed. The heat generation resistor b2 is formed on the substrate b1 by screen printing to have a thickness of about 10 μm. One of the ends of the heat generation resistor b2 is provided with an electrode portion b3, and the electrode portion b3 is electrically connected to the commercial power source 52. An alternating-current voltage applied from the commercial power source 52 to the electrode portion b3 causes a current to flow in the heat generation resistor b2 via the electrode portion b3, and the heat generation resistor b2 generates heat. Further, as illustrated in FIG. 4B, the heater 31*b* includes a protection layer b4 which protects the heat generation resistor b2. The protection layer b4 has a thickness of 60 μm and is formed by a glass coating.

As illustrated in FIG. 3, a thermistor 31*e* which detects the temperature of the heater 31*b* is attached to a surface of the heater 31*b* that is opposite to a surface that is in contact with the film 31*a*. The controller circuit 23 performs control to turn on/off the bidirectional thyristor 51 based on a result of detection by the thermistor 31*e*, and the amount of current flowing in the heat generation resistor b2 is adjusted by the control to adjust the temperature of the heater 31*b*.

The support portion 31*c* is made of a liquid crystal polymer and has rigidity, heat resistance, and heat insulation properties. The support portion 31*c* has the role of supporting the inner periphery of the film 31*a* being in contact with the support portion 31*c* and the role of supporting the heater 31*b*. The pressing stay 31*d* has a U-shaped cross section when viewed from the lengthwise direction in order to increase the flexural rigidity of the heating member 31. The pressing stay 31*d* is formed by bending a stainless-steel plate having a thickness of 1.6 mm.

When the fixing unit 14 fixes a toner image to the transfer medium P, a rotation force from the driving source M is transmitted to the pressing member 30, and the pressing member 30 is driven and rotated in the direction of an arrow R2 specified in FIG. 3 at a predetermined speed, as illustrated in FIG. 3. In this way, the film 31*a* is driven by the rotation of the pressing member 30 while rubbing against the heater 31*b*.

The transfer medium P is brought into the fixing nip portion Nf while the film 31*a* and the pressing member 30 are rotated, a current is applied to the heater 31*b*, and the temperature detected by the thermistor 31*e* of the heater 31*b* reaches a target temperature. The toner image transferred onto the transfer medium P in the transfer nip portion Nt is heated and pressed while the transfer medium P is conveyed through the fixing nip portion Nf, whereby the toner image is melted and fixed to the transfer medium P. The transfer medium P conveyed through the fixing nip portion Nf is separated from the film 31*a* due to the curvature of the film 31*a* and discharged to the sheet discharge tray 17 by the pair of sheet discharge rollers 16.

The distance from the transfer nip portion Nt to the fixing nip portion Nf in the image forming apparatus 100 is 40 mm in the present exemplary embodiment. Thus, when an image is formed on a normal A4-size or letter-size transfer medium P, a toner image is fixed onto the transfer medium P at the fixing unit 14 concurrently with the transfer of the toner image from the photosensitive drum 1 onto the transfer medium P in the transfer nip portion Nt.

[AC Banding Occurrence Mechanism]

Figure 5:
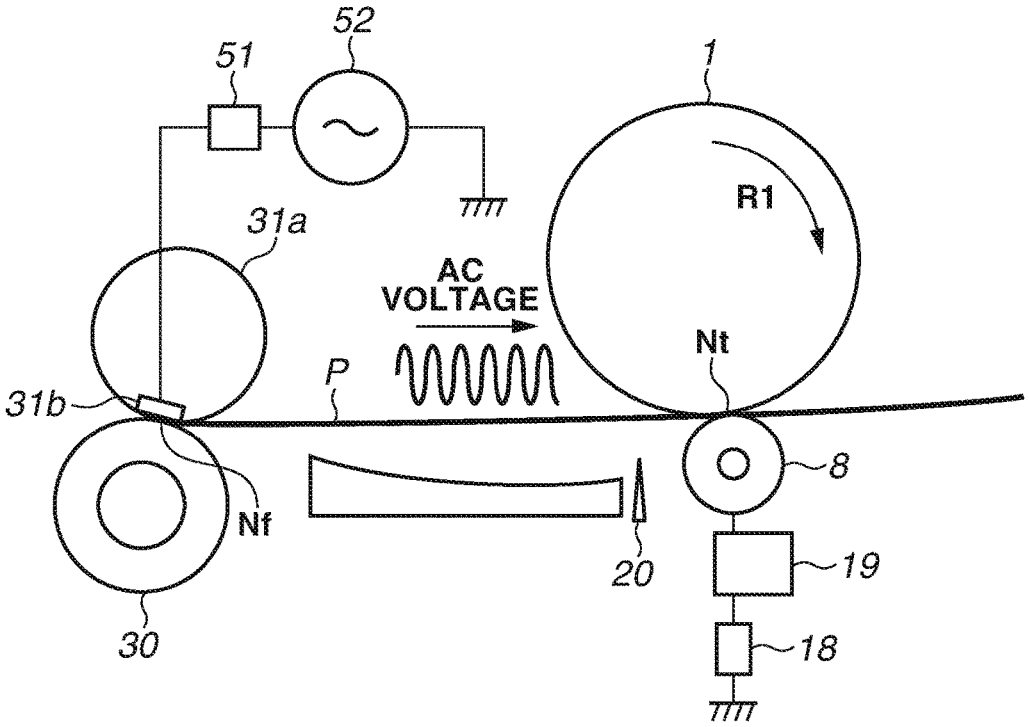
FIG. 5 is a schematic view illustrating a mechanism of a superimposition of an alternating-current (AC) voltage on a transfer voltage according to the first exemplary embodiment of the subject disclosure.

Next, image defects caused by a superimposition of the alternating-current voltage of the commercial power source 52 on the transfer voltage Vt in the transfer nip portion Nt via the transfer medium P having a low electric resistance, such as the transfer medium P having absorbed moisture, when an image is formed on the transfer medium P will be described below with reference to FIGS. 5 to 8. FIG. 5 is a schematic view illustrating a mechanism by which a superimposition of the alternating-current voltage of the commercial power source 52 on the transfer voltage Vt in the transfer nip portion Nt causes an image defect. The transfer medium P described below is the transfer medium P that is left under a high-temperature, high-humidity environment for a long time to absorb moisture and is an A4-size sheet having a length, in the direction in which the transfer medium P is conveyed, longer than 40 mm which is the distance from the transfer nip portion Nt to the fixing nip portion Nf.

When the transfer medium P that is left under a high-temperature, high-humidity environment or the like to absorb moisture is held in the fixing nip portion Nf while a toner image is transferred from the photosensitive drum 1 onto the transfer medium P in the transfer nip portion Nt, the alternating-current voltage is applied from the commercial power source 52 to the heater 31*b*. In FIG. 5, the transfer medium P held in the fixing nip portion Nf is in contact with the film 31*a* of the heating member 31, and the film 31*a* is in contact with the heater 31*b* in the fixing nip portion Nf. As illustrated in FIG. 4A, the heater 31*b* includes the substrate b1, which is conductive alumina with a low electric resistance, and the electrode portion b3 formed on the substrate b1, and the commercial power source 52 applies the alternating-current voltage to the electrode portion b3.

As illustrated in FIG. 5, in the case in which the electric resistance of the transfer medium P is low, the alternating-current voltage applied to the heater 31*b* changes the transfer voltage Vt in the transfer nip portion Nt via the film 31*a* and the transfer medium P. Consequently, the current flowing from the transfer roller 8 toward the photosensitive drum 1 is deflected by a waveform component (hereinafter, "AC waveform component") of the alternating-current voltage of the commercial power source 52.

Figure 6A:
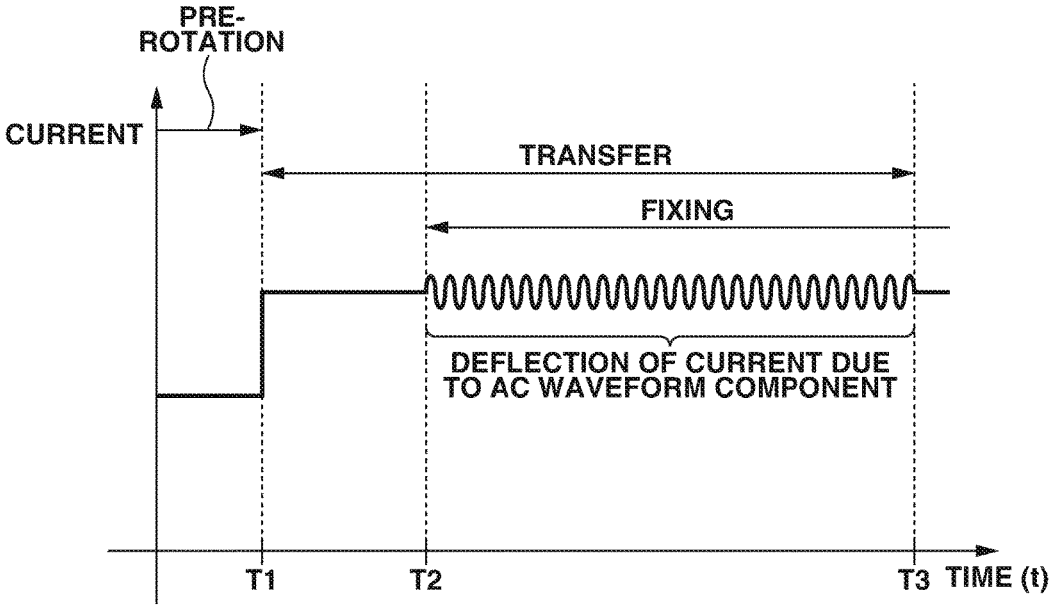
FIGS. 6A and 6B are graphs schematically illustrating an AC waveform component according to the first exemplary embodiment of the subject disclosure.
Figure 6B:
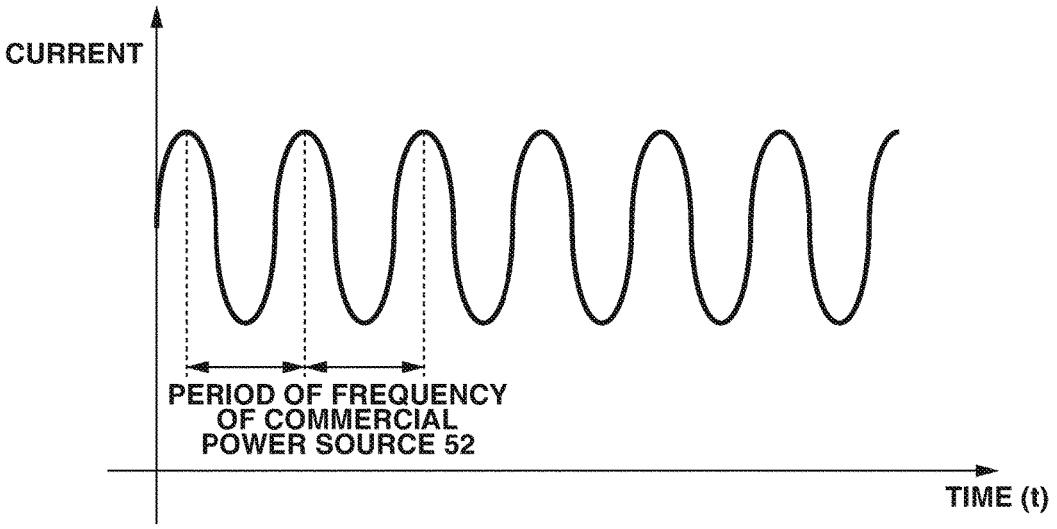

FIG. 6A is a schematic graph illustrating the current detected by the detection unit 19 when the alternating-current voltage of the commercial power source 52 is superimposed on the transfer voltage Vt in the transfer nip portion Nt. FIG. 6B is a schematic graph illustrating an enlarged waveform of the current deflected by the AC waveform component in FIG. 6A.

In FIG. 6A, time T1 is the time at which the transfer medium P enters the transfer nip portion Nt, and time T2 is the time at which the transfer medium P enters the fixing nip portion Nf. Before the time T2, the transfer medium P is not in the state in which the transfer medium P is held both in the transfer nip portion Nt and the fixing nip portion Nf, so the alternating-current voltage of the commercial power source 52 is not superimposed on the transfer power source 18 via the transfer medium P. On the other hand, at the time T2 and thereafter when the transfer medium P is held in both the transfer nip portion Nt and the fixing nip portion Nf, the alternating-current voltage of the commercial power source 52 is superimposed on the transfer power source 18 via the transfer medium P, and the current is deflected by the AC waveform component. Consequently, as illustrated in FIG. 6B, the current flowing in the transfer roller 8 is deflected with the period of frequency of the commercial power source 52. Time T3 is the time at which the transfer medium P passes through the fixing nip portion Nf, and at this time, the transfer medium P is not in the state in which the transfer medium P is held in both the transfer nip portion Nt and the fixing nip portion Nf.

Figure 7A:
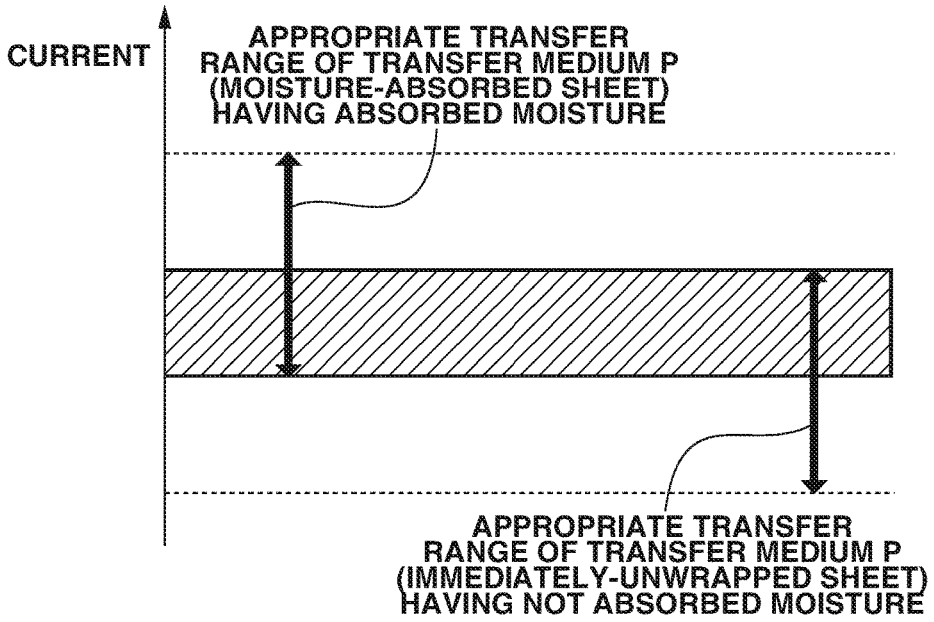
FIGS. 7A and 7B are graphs schematically illustrating an occurrence of AC banding in the first exemplary embodiment of the subject disclosure.
Figure 7B:
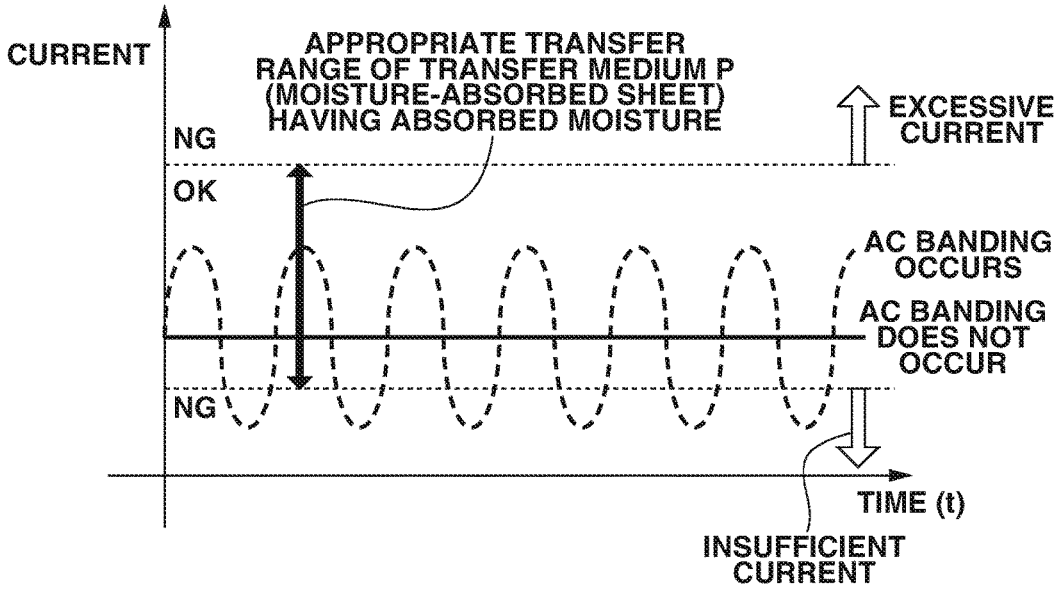
Figure 8:
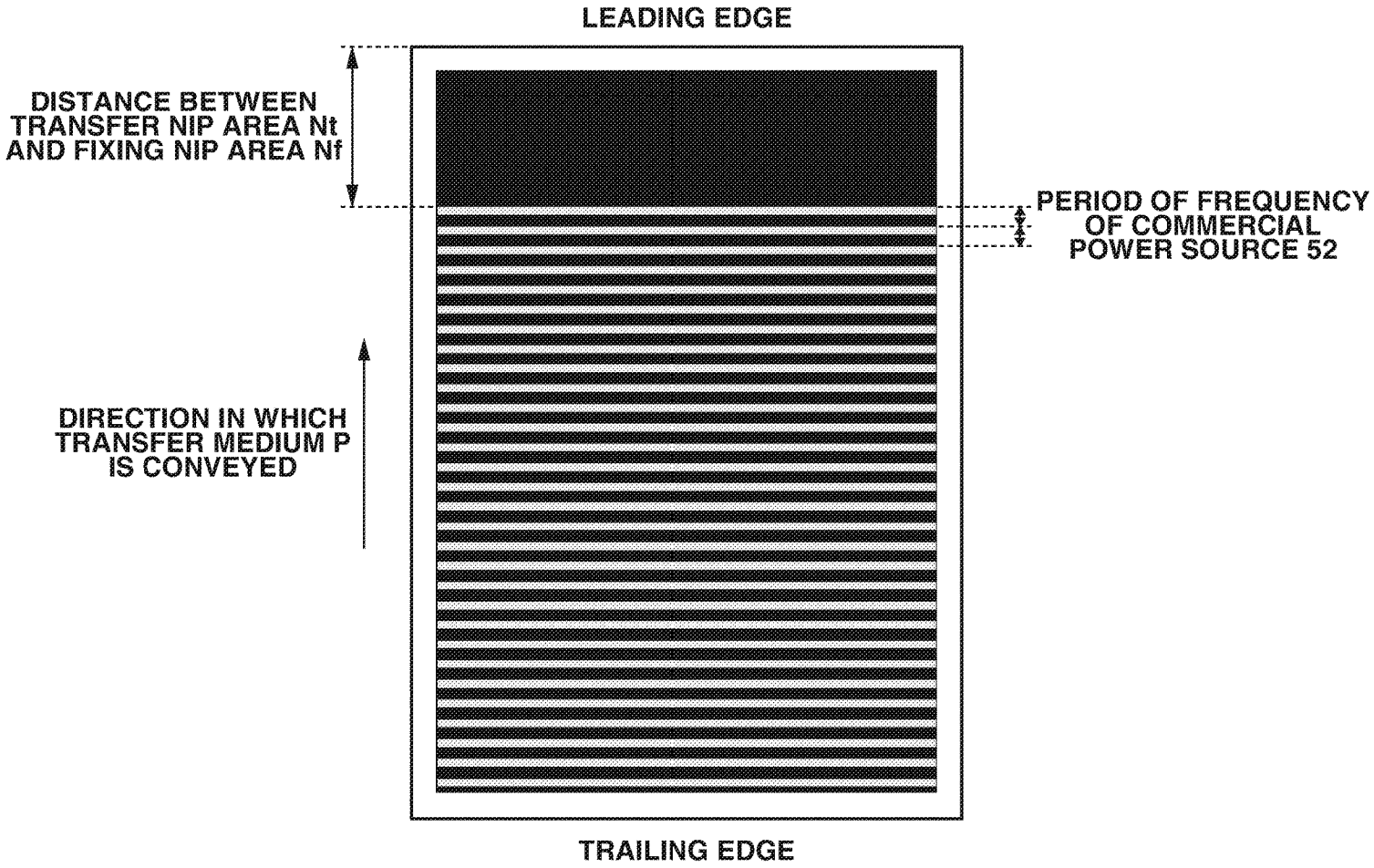
FIG. 8 is a schematic view illustrating an image in which AC banding occurs according to the first exemplary embodiment of the subject disclosure.

FIG. 7A is a schematic view illustrating that an appropriate range of the value of the current flowing from the transfer roller 8 to the photosensitive drum 1 to transfer a toner image from the photosensitive drum 1 onto the transfer medium P varies according to the electric resistance value of the transfer medium P. Further, FIG. 7B is a schematic graph illustrating an image defect (hereinafter, "AC banding") that occurs when the current flowing from the transfer roller 8 toward the photosensitive drum 1 is deflected by the AC waveform component. FIG. 8 is a schematic view illustrating an AC banding image.

As illustrated in FIG. 7A, an appropriate range of the value of the current flowing in the photosensitive drum 1 differs between the case of transferring a toner image onto the transfer medium P that has absorbed moisture and thus has a decreased electric resistance and the case of transferring a toner image onto the transfer medium P that has not absorbed moisture and thus has an electric resistance which is not decreased. Hereinafter, the transfer medium P having absorbed moisture and thus having a decreased electric resistance will be referred to as "moisture-absorbed sheet", and the transfer medium P immediately unwrapped and thus having not absorbed moisture to have an electric resistance which is not decreased will be referred to as "immediately-unwrapped sheet".

The moisture-absorbed sheet absorbs more moisture than the moisture absorbed by the immediately-unwrapped sheet, so the electric resistance of the moisture-absorbed sheet is low, and the current flowing from the transfer roller 8 to the photosensitive drum 1 leaks easily via the moisture-absorbed sheet. Thus, a larger amount of current needs to be passed from the transfer roller 8 to the photosensitive drum 1, and a high transfer voltage Vt needs to be applied from the transfer power source 18 to the transfer roller 8. Meanwhile, if a high transfer voltage Vt is applied to the immediately-unwrapped sheet, an excess current flows from the transfer roller 8 to the photosensitive drum 1 via the immediately-unwrapped sheet, whereby the polarity of the toner in the transfer nip portion Nt is inverted. Consequently, a toner image can be transferred inversely from the immediately-unwrapped sheet onto the photosensitive drum 1. This occurs because the electric resistance of the immediately-unwrapped sheet is not lower than the electric resistance of the moisture-absorbed sheet, so the amount of current leaking via the immediately-unwrapped sheet is small.

Thus, as illustrated in FIG. 7A, the value of the current flowing from the transfer roller 8 to the photosensitive drum 1 is desirably in a range of an overlap between an appropriate range of the current in the case of transferring a toner image onto the moisture-absorbed sheet and an appropriate range of the current in the case of transferring a toner image onto the immediately-unwrapped sheet. In the present exemplary embodiment, the transfer voltage Vt that leads to a flow of a current within the range of the overlap between the appropriate ranges in FIG. 7A is applied from the transfer power source 18 to the transfer roller 8.

When the transfer voltage Vt set as described above is applied from the transfer power source 18 to the transfer roller 8, if the alternating-current voltage of the commercial power source 52 is superimposed on the transfer voltage Vt, the current flowing from the transfer roller 8 to the photosensitive drum 1 is deflected by the AC waveform component to have a waveform as illustrated in FIG. 7B. At this time, the current flowing from the transfer roller 8 to the photosensitive drum 1 is deflected with the period of frequency of the commercial power source 52, and valley portions of the waveform in FIG. 7B become lower than the appropriate range of the current in the case of transferring a toner image onto the moisture-absorbed sheet. This leads to a shortage of the current in the period of frequency of the commercial power source 52, and an image transferred from the photosensitive drum 1 onto the transfer medium P after the transfer medium P enters the fixing nip portion Nf becomes an AC banding image with non-uniform density in the period of frequency of the commercial power source 52 as illustrated in FIG. 8.

[AC Waveform Component Detection]

In the present exemplary embodiment, if the controller circuit 23 detects an AC waveform component based on a detection result input from the detection unit 19, the controller circuit 23 controls the transfer power source 18 to change the transfer voltage Vt. The following describes details of the control according to the present exemplary embodiment which is performed when an entirely black solid image was formed under a high-temperature, high-humidity environment with a room temperature of 32.5 degrees and a humidity of 80% on a transfer medium P of OCE Red Label A4-size sheet (grammage 80 g/m$^2$) that had been left under the same high-temperature, high-humidity environment for 48 hours or longer.

The circumferential speed of the photosensitive drum 1 in the present exemplary embodiment is 118 mm/seconds. The voltage of the commercial power source 52 is 220 V. The power source frequency is 50 Hz. Further, the value of the voltage V0 when ATVC control was performed to pass a current of 3 μA was 500 V. Based on this result, the controller circuit 23 set to 750 V the transfer voltage Vt to be applied from the transfer power source 18 to the transfer roller 8 during the transfer of a toner image from the photosensitive drum 1 onto the transfer medium P, and image forming was started.

Figure 9A:
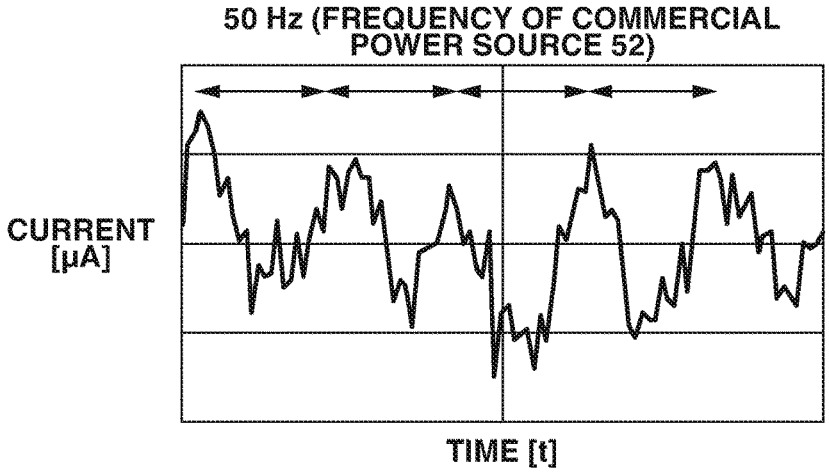
FIGS. 9A, 9B, and 9C are graphs schematically illustrating the control performed during the AC waveform component detection by a detection unit according to the first exemplary embodiment of the subject disclosure.
Figure 9B:
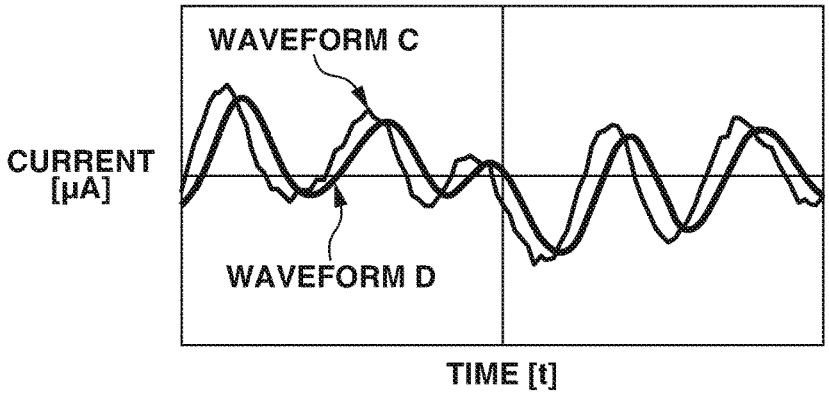
Figure 9C:
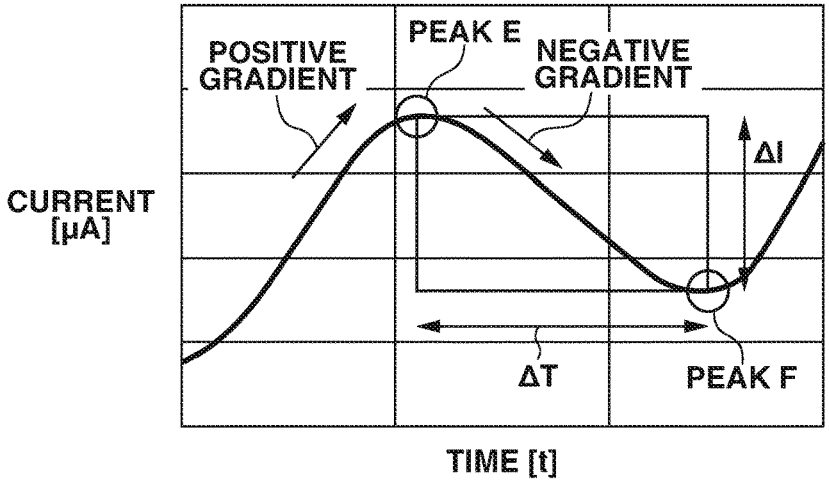
Figure 10:
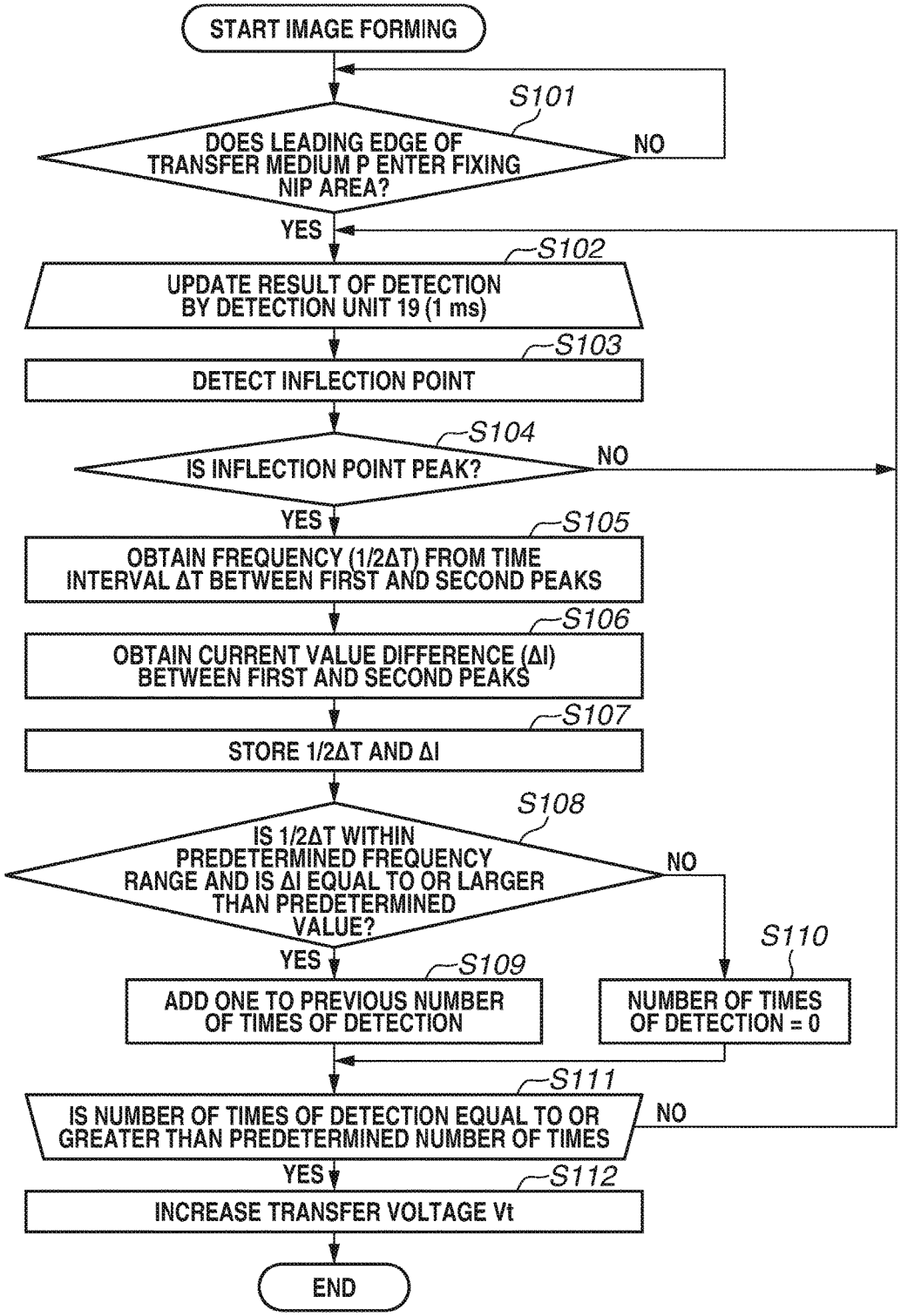
FIG. 10 is a flow chart illustrating the AC waveform component detection according to the first exemplary embodiment of the subject disclosure.

FIG. 9A is a graph illustrating a detection result of a current measured by the detection unit 19 when the alternating-current voltage from the commercial power source 52 is superimposed on the transfer voltage Vt. FIG. 9B is a graph obtained by calculating the simple moving average of the detection result illustrated in FIG. 9A. FIG. 9C is a graph illustrating an enlarged waveform obtained by calculating twice the simple moving average of the detection result in FIG. 9B. Further, FIG. 10 is a flow chart illustrating the control performed at the time of AC waveform component detection.

The current flowing in the transfer roller 8 is detected by the detection unit 19, and the detection result is input to the controller circuit 23. As illustrated in FIG. 10, when the image forming process is started and the leading edge of the transfer medium P reaches the fixing nip portion Nf (S101), a signal input from the detection unit 19 to the controller circuit 23 is updated at 1-ms intervals (S102). At this time, the detection unit 19 detects a signal containing noise as illustrated in FIG. 9A. To remove the noise, the simple moving average of the detection result (first detection result) acquired in FIG. 9A is calculated in the present exemplary embodiment, and a waveform C (first waveform) and a waveform D (second waveform) in FIG. 9B are obtained.

The simple moving average can also be considered as a low-pass filter, and a gain G suitable for use in calculating the simple moving average to obtain a waveform that the amplitudes of frequencies higher than a signal frequency f are attenuated is expressed by formula 1 below. The power source frequency of the commercial power source 52 in the present exemplary embodiment is 50 Hz, and the amplitudes of frequencies higher than 60 Hz are removed as noise from the detection result in FIG. 9A using formula 1 to obtain waveforms C and D. The score at which the amplitudes of frequencies higher than 60 Hz in the waveform of the detection result in FIG. 9A acquired at 1-ms intervals are attenuated (gain becomes $1/\sqrt{2}$) is calculated from formula 1, and the obtained score of the simple moving average (moving average score) is seven.

$$G = \frac{1}{2\pi f \tau}\sqrt{2(1-\cos 2\pi f \tau)} \tag{1}$$

(G: gain, τ=M (moving average score)×Δt (sampling interval=1 ms), f: signal frequency=60 Hz).

The waveform C in FIG. 9B is a waveform obtained by calculating the simple moving average of the waveform of the detection result in FIG. 9A when the moving average score is seven. In the case in which noise still remains in a waveform after the simple moving average is calculated once as in the case of the waveform C, waveform phase shifts and amplitude reduction are reduced not by increasing the moving average score and calculating the simple moving average using the increased moving average score but by calculating the simple moving average of the waveform C again. Thus, in order to make the power source frequency of the commercial power source 52 more detectable, the simple moving average of the waveform C is calculated using the moving average score of seven in the present exemplary embodiment to obtain the waveform D.

As illustrated in FIG. 9C, points (inflection points) in the waveform D, which is obtained as described above, at which the gradient changes are determined as peaks (S103 and S104), and a frequency obtained from an interval ΔT between the adjacent peaks is compared with a predetermined frequency range including the power source frequency of the commercial power source 52. In FIG. 9C, a peak E at which the gradient of the waveform D changes from positive to negative will be referred to as a first peak, and a peak F at which the gradient of the waveform D changes from negative to positive will be referred to as a second peak. As illustrated in FIGS. 9C and 10, a frequency ½ΔT is calculated from an interval ΔT between the peaks E and F (half period) in the present exemplary embodiment (S105).

Further, a difference (difference ΔI) between the current values at the peaks E and F, which are adjacent peaks, are calculated (S106), and the frequency ½ΔT at which the value of the difference ΔI is not smaller than a predetermined value and the difference ΔI are stored in the present exemplary embodiment (S107). The value of the difference ΔI is settable according to the control by the image forming apparatus 100, and the predetermined value of the difference ΔI is set to 1 μA in the present exemplary embodiment. Thereafter, as illustrated in FIG. 10, the controller circuit 23 determines whether the value of the frequency ½ΔT is within the predetermined frequency range including the power source frequency of the commercial power source 52 and the difference ΔI is equal to or larger than the predetermined value (S108).

The power source frequency of the commercial power source 52 that is used is 50 Hz, so if the value of frequency ½ΔT is within the predetermined frequency range 40 Hz<½ΔT<60 Hz, it is determined that the AC waveform component is detected. Then, in a case where the value of the frequency ½ΔT is within the range 40 Hz<½ΔT<60 Hz and the difference ΔI is equal to or larger than 1 μA, the controller circuit 23 determines that the AC waveform component is detected, adds one to the previous number of times of detection, and stores the resulting number of times of detection (S109). On the other hand, in a case where the condition that the value of the frequency ½ΔT is within the range 40 Hz<½ΔT<60 Hz and the difference ΔI is equal to or larger than 1 μA is not satisfied, the controller circuit 23 stores zero as the number of times of detection of the AC waveform component (S110).

As illustrated in FIG. 10, the control is performed to change the transfer voltage Vt in a case where the controller circuit 23 determines that the AC waveform component is detected a predetermined number of times or more in the present exemplary embodiment (S111 and S112). More specifically, the controller circuit 23 controls the transfer power source 18 to change the transfer voltage Vt from 750 V to 780 V. In this way, non-uniformity in image transfer caused by a shortage of current as illustrated in FIG. 7B is reduced.

The current flowing in the transfer roller 8 can be deflected at the moment when the transfer medium P enters the fixing nip portion Nf or can be deflected by a change in the amount of toner borne on the photosensitive drum 1. In order to determine the presence/absence of AC banding with great accuracy through removing such noise, it is desirable to change the transfer voltage Vt if the number of times of AC waveform component detection is equal to or larger than the predetermined number of times.

For example, in the case in which the predetermined number of times is set to two, the transfer voltage Vt is changed if the values of the frequency ½ΔT are each within the range 40 Hz<½ΔT<60 Hz and the differences ΔI are each equal to or larger than 1 μA with respect to three consecutive peaks. The predetermined number of times is desirably at least two or more, and in the present exemplary embodiment, the predetermined number of times is set to four, and the differences ΔI and the values of the frequency ½ΔT with respect to five consecutive peaks (2.5 periods) are compared. If more peaks are compared, the accuracy of the AC waveform component detection is further improved. However, if the predetermined number of times is increased, the detection time becomes longer. Thus, in the present exemplary embodiment, the predetermined number of times is set to four so that the controller circuit 23 determines the presence/absence of AC banding with great accuracy while image defects are reduced.

Alternatively, the controller circuit 23 can determine that the AC waveform component is detected if the value of the frequency ½ΔT is within the predetermined frequency range 40 Hz<½ΔT<70 Hz. In this way, the power source frequencies of 50 Hz and 60 Hz are both included within the predetermined frequency range so that the AC waveform component detection is executable regardless of whether the power source frequency of the commercial power source is 50 Hz or 60 Hz.

While the controller circuit 23 performs the control to increase the transfer voltage to be applied from the transfer power source 18 to the transfer roller 8 in a case where it is determined that AC banding occurs in the present exemplary embodiment, the control is not limited to the above-described control. For example, in the case in which the transfer voltage to be applied from the transfer power source 18 to the transfer roller 8 is set high in advance and the value of current flowing from the transfer roller 8 to the photosensitive drum 1 is set to a value near an upper limit value of the appropriate range of the current for the case of transferring a toner image onto the transfer medium P having absorbed moisture, and if AC banding occurs to deflect the current flowing in the transfer roller 8 in the period of frequency of the commercial power source 52, peak portions of the waveform of the transfer current become higher than the appropriate range of the current for the case of transferring a toner image onto a moisture-absorbed sheet.

Consequently, the current becomes excessive in the period of frequency of the commercial power source 52, and images transferred from the photosensitive drum 1 onto the transfer medium P when or after the transfer medium P enters the fixing nip portion Nf can include non-uniform shades in the period of frequency of the commercial power source 52. Thus, in the case in which the transfer voltage to be applied from the transfer power source 18 to the transfer roller 8 is set high in advance, the controller circuit 23 performs control to decrease the transfer voltage based on the detection result input from the detection unit 19 so that image defects are reduced.

Further, the electric resistance between the transfer medium P and the photosensitive drum 1 can be changed by the amount of toner transferred from the photosensitive drum 1 onto the transfer medium P in the transfer nip portion Nt, and this can deflect a current signal detected by the detection unit 19. To prevent erroneous detection of AC banding due to the current deflection, information about the printing ratio in the direction in which the transfer medium P is conveyed may be acquired in advance to predict a current deflection based on the acquired information and execute correction. Alternatively, the AC banding detection can be stopped temporarily for a predetermined time from the timing of a change in the printing ratio in order to prevent erroneous detection.

Similarly, a deflection in a current signal detected by the detection unit 19 can occur also due to non-uniform thickness in the circumferential direction of the photosensitive drum 1, a change in the electric resistance of the transfer roller 8, etc. Thus, for example, the current flowing from the transfer power source 18 to the transfer roller 8 can be detected at the detection unit 19 before the transfer medium P reaches the transfer nip portion Nt, during a sheet interval between the transfer mediums P, etc., to reflect the detection result in the AC banding detection. Specifically, a change in the electric resistance of the photosensitive drum 1 or the transfer roller 8 is predicted from the current value detected by the detection unit 19 while the transfer medium P is not held in the transfer nip portion Nt, and the condition for AC banding detection or the detection result is corrected.

Further, while the detection unit 19 is configured to detect a periodical deflection in the current flowing in the transfer roller 8 in the present exemplary embodiment, the configuration is not limited to the above-described configuration. An advantage of the present exemplary embodiment is also produced by detecting a periodical deflection in the transfer voltage in the case in which constant current control is performed to control the output voltage of the transfer power source 18 to pass a constant current from the transfer roller 8 to the photosensitive drum 1 during the transfer of a toner image onto the transfer medium P. To detect the transfer voltage, a voltage detection circuit which serves as a detection unit is provided between the transfer roller 8 and the transfer power source 18, e.g., a resistor for detection having a known resistance value is situated between the transfer roller 8 and the transfer power source 18.

In the first exemplary embodiment, the control performed to uniformly change the voltage to be applied from the transfer power source 18 to the transfer roller 8 in a case in which it is determined that AC banding occurs is described. A second exemplary embodiment is different from first exemplary embodiment in that the voltage to be applied from the transfer power source 18 to the transfer roller 8 is changed according to the phase of the power source frequency of the commercial power source 52 in a case in which it is determined that AC banding occurs. The present exemplary embodiment is similar to the first exemplary embodiment except that the voltage to be applied from the transfer power source 18 to the transfer roller 8 is changed according to the phase of the power source frequency of the commercial power source 52, so similar components are given the same reference numerals, and description of the similar components is omitted.

Figure 11A:
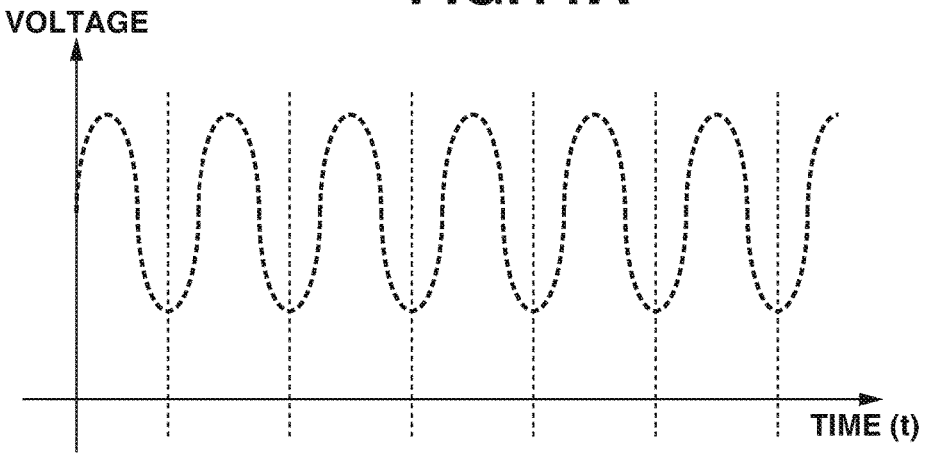
FIGS. 11A, 11B, and 11C are schematic graphs for a comparison between the control according to the first exemplary embodiment and the control according to a second exemplary embodiment of the subject disclosure.
Figure 11B:
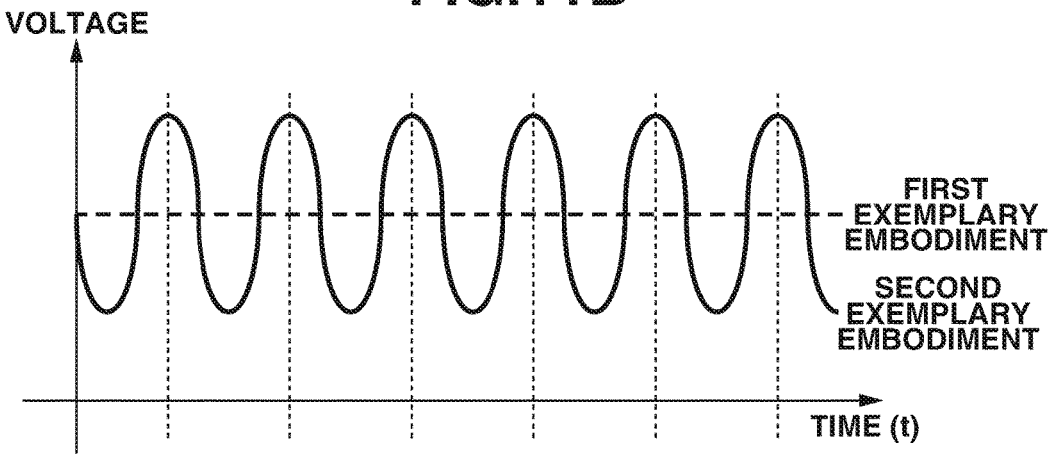
Figure 11C:
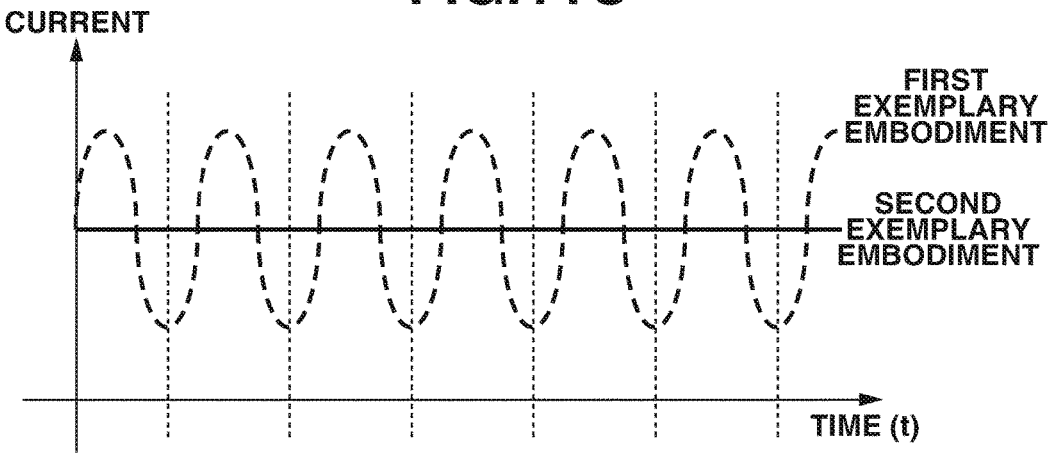

FIG. 11A is a schematic graph illustrating the voltage of the transfer nip portion Nt at the time of occurrence of AC banding. FIG. 11B is a schematic graph illustrating the voltage to be applied from the transfer power source 18 to the transfer roller 8 in a case in which AC banding is detected in the first and second exemplary embodiments. FIG. 11C is a schematic graph illustrating the current detected by the detection unit 19 if AC banding occurs and the controller circuit 23 controls the transfer power source 18 in the first and second exemplary embodiments. In FIGS. 11B and 11C, the first exemplary embodiment is specified by a broken line, and the second exemplary embodiment is specified by a solid line.

As illustrated in FIGS. 11A, and 11B, the voltage to be applied from the transfer power source 18 to the transfer roller 8 is changed according to the phase of the power source frequency of the commercial power source 52 by the controller circuit 23 if AC banding is detected in the present exemplary embodiment. Specifically, the voltage to be applied from the transfer power source 18 to the transfer roller 8 is set larger than the voltage applied to the transfer roller 8 before the detection of the AC banding during the time periods corresponding to valley portions of the waveform of the voltage in FIG. 11A. On the other hand, the voltage to be applied from the transfer power source 18 to the transfer roller 8 is set smaller than the voltage applied to the transfer roller 8 before the detection of the AC banding during the time periods corresponding to peak portions of the waveform. In this way, the voltage to be applied from the transfer power source 18 to the transfer roller 8 is periodically controlled according to the phase of the power source frequency of the commercial power source 52, not as in the first exemplary embodiment in which a voltage of the same value is uniformly applied, and the waveform as illustrated in FIG. 11B is obtained.

In this case, the current detected by the detection unit 19 after the control on the transfer power source 18 is changed is smoothed as illustrated in FIG. 11C. Accordingly, the present exemplary embodiment not only produces the advantage of the first exemplary embodiment but also prevents a fluctuation in the current flowing in the transfer nip portion Nt during the transfer of a toner image from the photosensitive drum 1 onto the transfer medium P so that the transferability of the toner image is stabilized.

Figure 12:
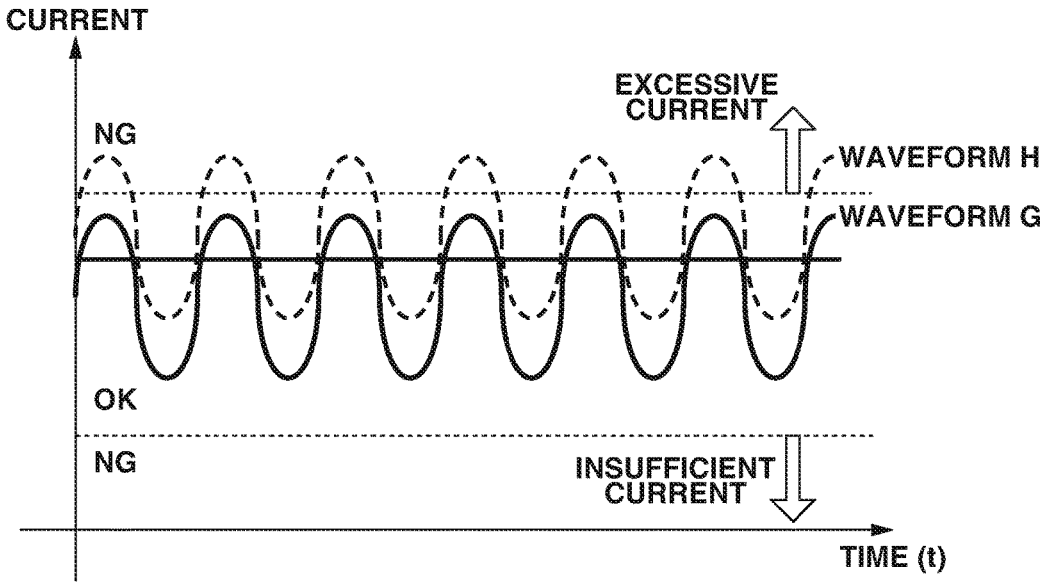
FIG. 12 is a schematic view illustrating a possible issue that can arise as a result of unsuccessfully setting an appropriate transfer voltage in a third exemplary embodiment of the subject disclosure.

In a third exemplary embodiment of the present disclosure, as illustrated in FIGS. 12 and 13, a condition based on which the controller circuit 23 determines whether to change the transfer voltage Vt is set to set a more appropriate transfer voltage when it is determined that AC banding occurs. In the following description, components that are similar to those in the first exemplary embodiment are given the same reference numerals as those in the first exemplary embodiment, and description of the similar components is omitted. FIG. 12 is a schematic diagram illustrating a possible problem that can occur if an appropriate transfer voltage cannot be set in the case in which it is determined that AC banding occurs. FIG. 13 is a flow chart for setting an appropriate transfer voltage in the present exemplary embodiment.

In FIG. 12, a waveform G is a waveform illustrating the case in which no image defect occurs although the transfer voltage Vt is applied from the transfer power source 18 to the transfer roller 8 and the AC waveform component is detected the predetermined number of times or more. A waveform H is a waveform of the current detected by the detection unit 19 in the case in which it is determined that AC banding occurs and the controller circuit 23 increases the transfer voltage Vt based on the detection result of the waveform G. As illustrated in FIG. 12, although the AC waveform component is detected the predetermined number of times or more, an appropriate current can flow from the transfer roller 8 to the photosensitive drum 1 depending on the preset value of the transfer voltage Vt, as in the case of the waveform G. In this state, if the controller circuit 23 changes the transfer voltage Vt to a larger value, peak portions of the waveform H become higher than the appropriate current range as specified by the waveform H to cause an excess current to flow in the photosensitive drum 1.

Thus, in the present exemplary embodiment, as illustrated in FIG. 13, the control to change the transfer voltage Vt to a larger value is performed only if it is determined that the AC waveform component is detected the predetermined number of times or more and an image defect can occur due to a shortage of the current flowing from the transfer roller 8 to the photosensitive drum 1. Specifically, the transfer voltage Vt is changed in a case in which the AC waveform component is detected the predetermined number of times or more and valley portions of the waveform of the current detected by the detection unit 19 are likely to be lower than the appropriate current range, whereas the transfer voltage Vt is not changed in a case in which the AC waveform component is detected the predetermined number of times or more and the valley portions are not likely to become lower than the appropriate current range. The controller circuit 23 determines whether the condition for increasing the transfer voltage Vt is satisfied based on information input to the controller circuit 23 (S212), and changes the transfer voltage Vt to a larger value (S213). Since the control which is performed from S201 to S211 in the flowchart illustrated in FIG. 13 is the same as the control performed in the flowchart illustrated in FIG. 10, the detailed description will be omitted. The condition for changing the transfer voltage Vt by the controller circuit 23 will be described below.

<Case in which Electric Resistance of Transfer Medium P is Low>

In the case in which the electric resistance of the transfer medium P is low, the current flowing from the transfer roller 8 to the photosensitive drum 1 can leak through the transfer medium P. Specifically, the current needed to transfer a toner image onto the transfer medium P is likely to be a value near a lower limit of a range of an overlap between the appropriate current range for the case of transferring a toner image onto a moisture-absorbed sheet and the appropriate current range for the case of transferring a toner image onto a immediately-unwrapped sheet in FIG. 7A. Thus, in the case in which the AC waveform component is detected the predetermined number of times or more at the time of transferring a toner image onto the transfer medium P having a low electric resistance, AC banding can occur due to a partial shortage of the current flowing from the transfer roller 8 to the photosensitive drum 1 as illustrated in FIG. 7B described above.

In the present exemplary embodiment, first, whether a toner image is transferred onto the transfer medium P having a low electric resistance in the transfer nip portion Nt is determined based on the detection result (second detection result) input from the environment sensor 24 to the controller circuit 23. In the case in which the image forming apparatus 100 is surrounded by a high-temperature, high-humidity environment, the electric resistance of the transfer medium P stored in the sheet feeding cassette 9 is likely to be low. Thus, if the temperature or humidity detection result (second detection result) detected by the environment sensor 24 is not lower than a predetermined value, the controller circuit 23 changes the transfer voltage Vt to a larger value so that AC banding images are less likely to be produced.

The environment sensor 24 can be situated in a position inside the image forming apparatus 100 in which the environment sensor 24 is less likely to be affected by an increase in the temperature of the environment sensor 24. Further, while the surrounding environment is determined from the detection result input from the environment sensor 24 to the controller circuit 23 in the present exemplary embodiment, the surrounding environment determination is not limited to the above-described determination. For example, the surrounding environment can be determined based on surrounding environment data input from the personal computer 21 to the controller circuit 23 or surrounding environment data input by a user to the image forming apparatus 100 without providing the environment sensor 24 to the image forming apparatus 100.

Further, the electric resistance of the transfer medium P can be changed not only by the surrounding environment but also by the grammage of the transfer medium P or components contained in the transfer medium P. In general, the transfer medium P that has a large grammage is likely to have a high electric resistance. Thus, for example, in the case in which the type of the transfer medium P is known in advance based on a print mode input by a user, the controller circuit 23 can determine the transfer medium P as having a large grammage and change the transfer voltage Vt to a larger value to reduce AC banding. Alternatively, the medium sensor 26 of the image forming apparatus 100 can determine the type of the transfer medium P conveyed to the transfer nip portion Nt. In the case in which the type of the transfer medium P is determined using information about the print mode or information about the transfer medium P which is input to the image forming apparatus 100 by the user, the image forming apparatus 100 can but does not have to include the medium sensor 26.

Further, the electric resistance of the transfer medium P can be estimated by comparing the current value detected by the detection unit 19 while the transfer medium P is not held in the transfer nip portion Nt with the current value detected by the detection unit 19 while the transfer medium P is held in the transfer nip portion Nt. The electric resistance of the transfer medium P can be estimated from the current detection result detected by the detection unit 19 and the voltage applied from the transfer power source 18 to the transfer roller 8 when and after the leading edge of the transfer medium P is held in the transfer nip portion Nt and before the leading edge of the transfer medium P reaches the fixing nip portion Nf. If the estimated electric resistance of the transfer medium P is lower than a predetermined value, the controller circuit 23 determines that the transfer medium P has a low electric resistance, and the transfer voltage Vt is changed to a larger value to reduce AC banding.

Further, in the case in which the transfer voltage Vt applied from the transfer power source 18 to the transfer roller 8 at the time of transferring a toner image onto the transfer medium P is the lower limit voltage Vt1, it is considered that the electric resistance of the transfer medium P held in the transfer nip portion Nt is low. Thus, in the case in which the lower limit voltage Vt1 is applied from the transfer power source 18 to the transfer roller 8 when the AC waveform component is detected, a voltage that is larger than the lower limit voltage Vt1 is applied to reduce AC banding.

<Case in which Output Voltage of Commercial Power Source 52 is High>

The deflection range of the current flowing from the transfer roller 8 to the photosensitive drum 1 when the alternating-current voltage of the commercial power source 52 is superimposed on the transfer voltage Vt varies according to the voltage of the commercial power source 52. In the case in which the value of voltage output from the commercial power source 52 is large, the deflection range of the current flowing from the transfer roller 8 to the photosensitive drum 1 becomes large, so AC banding can occur due to a partial shortage of the current flowing from the transfer roller 8 to the photosensitive drum 1. Thus, the transfer voltage Vt can be changed to a larger value if the controller circuit 23 detects the AC waveform component the predetermined number of times or more and the voltage of the commercial power source 52 detected by the voltage detection unit 25 is larger than a predetermined value.

In the present exemplary embodiment, the transfer voltage Vt is changed from 750 V to 780 V if the controller circuit 23 detects the AC waveform component the predetermined number of times or more and determines that the condition for increasing the transfer voltage Vt is satisfied. In this way, non-uniformity in image transfer caused by a shortage of current as illustrated in FIG. 7B is reduced.

As described above, in the present exemplary embodiment, an appropriate transfer voltage is settable based on information input to the controller circuit 23 in the case in which the controller circuit 23 detects the AC waveform component the predetermined number of times or more. Alternatively, whether the condition for increasing the transfer voltage Vt is satisfied can be determined using only one of the above-described conditions or a combination of two or more of the conditions.

In the first exemplary embodiment, the control performed by the controller circuit 23 in the case in which AC banding occurs on one transfer medium P is described. In a fourth exemplary embodiment, the control performed by the controller circuit 23 in the case of continuously forming an image on a plurality of transfer mediums P (hereinafter, "continuous printing") will be described below with reference to FIG. 14. In the present exemplary embodiment, the controller circuit 23 reflects the transfer voltage set to a first transfer medium P1 in the transfer voltage set to a second transfer medium P2 following the first transfer medium P1 when a continuous printing job is executed. Components and control that are similar to those in the first exemplary embodiment are given the same reference numerals as those in the first exemplary embodiment, and description thereof is omitted.

Figure 14:
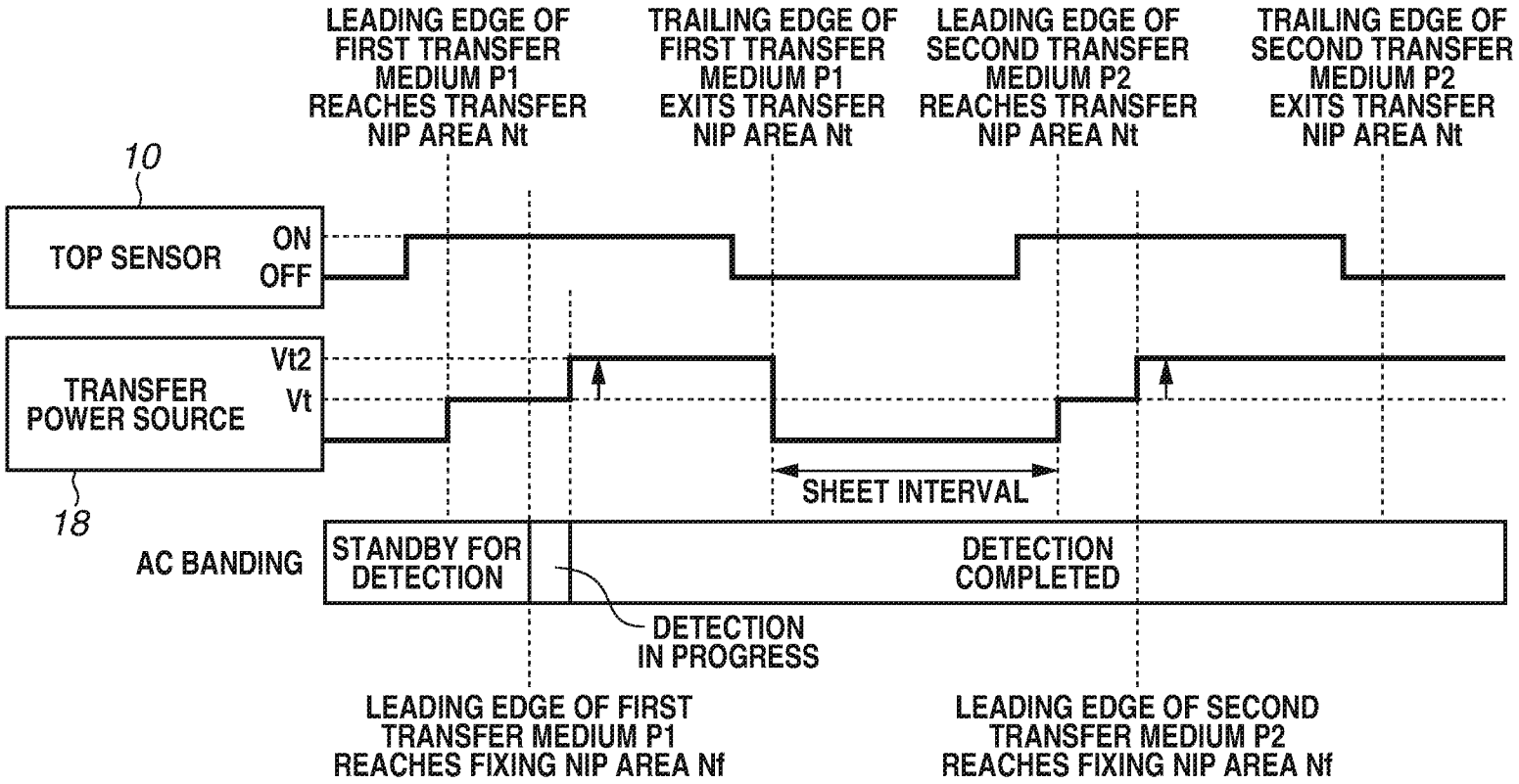
FIG. 14 is a timing chart according to a fourth exemplary embodiment of the subject disclosure.

FIG. 14 is a timing chart of the control performed on the transfer power source 18 by the controller circuit 23 in the present exemplary embodiment. As illustrated in FIG. 14, if the top sensor 10 detects the leading edge of the first transfer medium P1 in the direction in which the transfer mediums are conveyed, the controller circuit 23 applies the transfer voltage Vt from the transfer power source 18 to the transfer roller 8 at the timing at which the leading edge of the first transfer medium P1 reaches the transfer nip portion Nt. Thereafter, if the AC waveform component is detected the predetermined number of times or more, the controller circuit 23 changes the transfer voltage Vt to the transfer voltage Vt2 which has the absolute value larger than the absolute value of the transfer voltage Vt. At this time, a toner image is transferred from the photosensitive drum 1 onto the first transfer medium P1 in the transfer nip portion Nt by the current flowing from the transfer roller 8, to which the transfer voltage Vt2 is applied, to the photosensitive drum 1.

In the present exemplary embodiment, in the case in which there is a remaining job of forming an image on the second transfer medium P2 following the first transfer medium P1 when a toner image is transferred onto the first transfer medium P1, the AC waveform component detection is not performed on the second transfer medium P2. The transfer mediums P stored in the sheet feeding cassette 9 are placed under the same environment and are considered similar in type and state. Thus, the voltage to be applied from the transfer power source 18 to the transfer roller 8 with respect to the second transfer medium P2 is changed to the transfer voltage Vt2 by the controller circuit 23 at the timing at which the second transfer medium P2 is held in the fixing nip portion Nf. In this way, an appropriate transfer voltage is set also with respect to the second transfer medium P2 to reduce AC banding.

As described above, in the present exemplary embodiment, the controller circuit 23 does not determine whether AC banding occurs on the second transfer medium P2 following the first transfer medium P1 in the case of executing a continuous printing job. This reduces AC banding while reducing the number of times of AC waveform detection at the time of executing a continuous printing job.

While the transfer voltage Vt is changed if the controller circuit 23 determines that the AC waveform component is detected the predetermined number of times or more in above description of the present exemplary embodiment, the present exemplary embodiment is not limited to that described above. A similar advantage is produced also by changing the transfer voltage Vt if the controller circuit 23 determines that the AC waveform component is detected the predetermined number of times or more and the condition for increasing the transfer voltage Vt is satisfied, as already described above in the third exemplary embodiment.

In the fourth exemplary embodiment, the controller circuit 23 performs control to change the voltage to be applied from the transfer power source 18 to the transfer roller 8 to the transfer voltage Vt2 at the timing at which the second transfer medium P2 following the first transfer medium P1 reaches the fixing nip portion Nf. A fifth exemplary embodiment is different from the second exemplary embodiment in that the transfer voltage Vt2 is applied from the transfer power source 18 to the transfer roller 8 at the timing at which the second transfer medium P2 reaches the transfer nip portion Nt when a continuous printing job is executed. The present exemplary embodiment is similar to the fourth exemplary embodiment except that the transfer voltage Vt2 is applied from the transfer power source 18 to the transfer roller 8 at the timing at which the second transfer medium P2 reaches the transfer nip portion Nt. Similar points to those in the fourth exemplary embodiment are given the same reference numerals, and description thereof is omitted.

Figure 15:
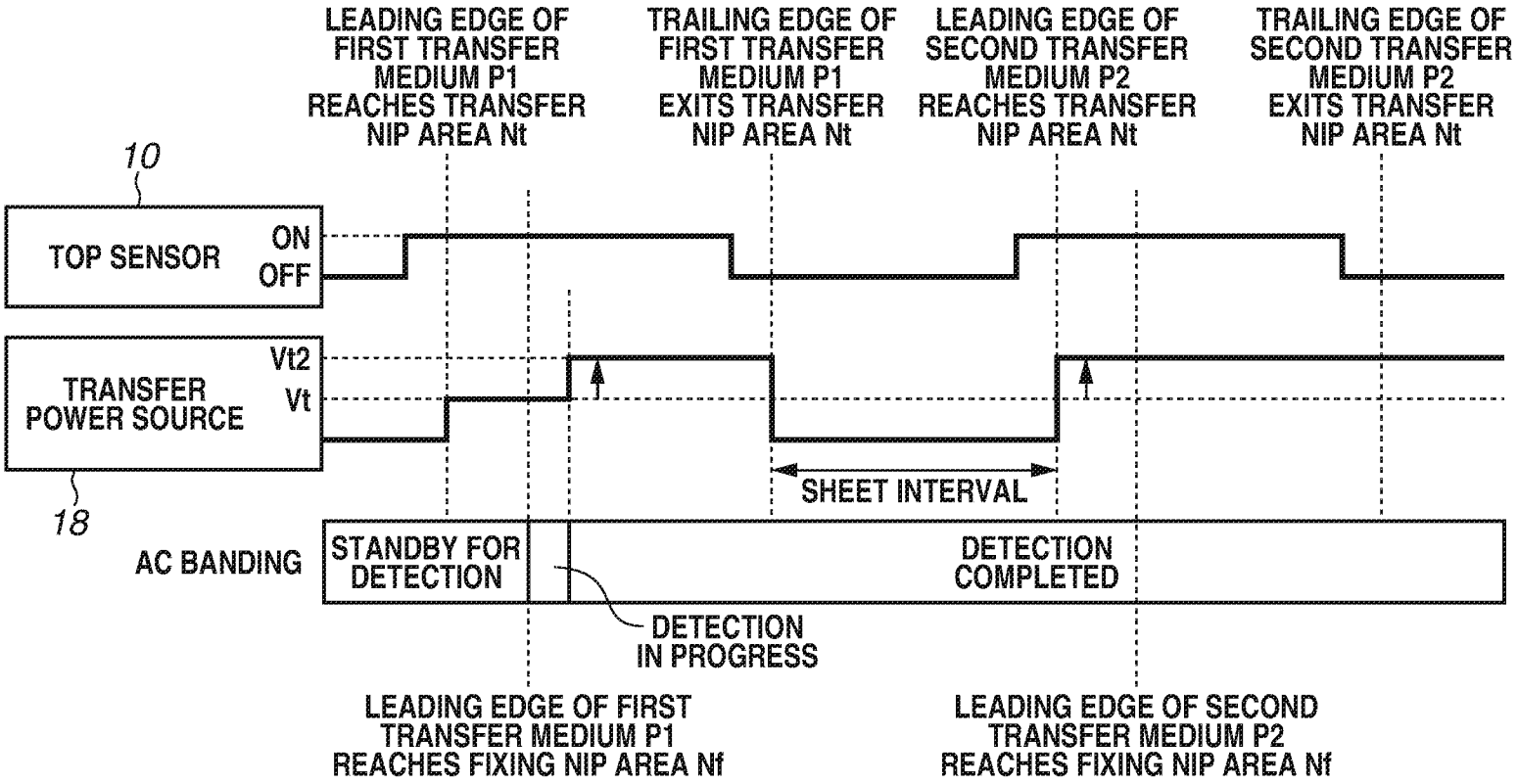
FIG. 15 is a timing chart according to a fifth exemplary embodiment of the subject disclosure.

FIG. 15 is a timing chart of the control performed on the transfer power source 18 by the controller circuit 23 in the present exemplary embodiment. As illustrated in FIG. 15, in the present exemplary embodiment, the transfer voltage Vt2 is applied from the transfer power source 18 to the transfer roller 8 at the timing at which the leading edge of the second transfer medium P2 reaches the transfer nip portion Nt in the direction in which the transfer mediums are conveyed. The transfer voltage Vt2 is the voltage applied from the transfer power source 18 to the transfer roller 8 when the controller circuit 23 determines that AC banding occurs on the first transfer medium P1 and the transfer voltage Vt is changed.

As described above in the third exemplary embodiment, a possible condition under which AC banding is likely to occur is the case of forming an image on the transfer medium P having a low electric resistance. In the case of forming an image on the transfer medium P having a low electric resistance, the current flowing from the transfer roller 8 toward the photosensitive drum 1 is likely to leak through the transfer medium P. Thus, in the case in which the electric resistance of the transfer medium P is likely to be low, even if a voltage of a larger value than the transfer voltage Vt is applied to the transfer roller 8 before the transfer medium P reaches the fixing nip portion Nf, an excessive flow of current from the transfer roller 8 to the photosensitive drum 1 is less likely to occur.

Accordingly, in the present exemplary embodiment, the transfer voltage Vt2 is applied from the transfer power source 18 to the transfer roller 8 at the timing at which the leading edge of the second transfer medium P2, on which AC banding is likely to occur as in the case of the first transfer medium P1, reaches the transfer nip portion Nt. As described above, the transfer voltage Vt2 is applied from the transfer power source 18 to the transfer roller 8 by the controller circuit 23 before the leading edge of the second transfer medium P2 reaches the fixing nip portion Nf so that AC banding is more likely to be reduced.

In the first exemplary embodiment, the control performed by the controller circuit 23 to change the transfer voltage Vt if it is determined that AC banding occurs when one job is executed is described. In a sixth exemplary embodiment, the control performed by the controller circuit 23 in a first job for which the transfer voltage Vt is changed because it is determined that AC banding occurs is reflected in a second job following the first job when a plurality of jobs is executed. Components and control in the present exemplary embodiment that are similar to those in the first exemplary embodiment are given the same reference numerals as those in the first exemplary embodiment, and description thereof is omitted.

As described above in the fourth and fifth exemplary embodiments, the transfer mediums P stored in the sheet feeding cassette 9 are placed under the same environment and are likely to be similar in type and state. Thus, in the present exemplary embodiment, when a plurality of jobs is executed, if it is determined that the transfer mediums P are similar in type and state, the voltage applied from the transfer power source 18 to the transfer roller 8 in the first job is reflected in the second job after the first job is ended.

For example, in the case in which no access to the sheet feeding cassette 9 is made by the user, the transfer mediums P stored in the sheet feeding cassette 9 are likely to be similar in type and state. Specifically, one of the methods of detecting the presence/absence of user access to the sheet feeding cassette 9 is to provide a detection unit configured to detect the opening/closing of the sheet feeding cassette 9. In this case, the controller circuit 23 determines whether the sheet feeding cassette 9 is opened/closed between the first and second jobs of respectively forming images on the transfer mediums P fed from the same sheet feeding cassette 9. If the controller circuit 23 determines that the sheet feeding cassette 9 is not opened/closed and AC banding occurs in the first job, the voltage of a larger value than the transfer voltage Vt which is changed from the transfer voltage Vt by the controller circuit 23 in the first job is reflected in the forming of an image in the second job.

Alternatively, it can be determined that no user access to the sheet feeding cassette 9 is made if a second job signal is input to the controller circuit 23 while an image is formed in the first job or during post-image-forming processing in the first job.

Further, for example, the values of current input from the detection unit 19 to the controller circuit 23 while the transfer medium P is not held in the fixing nip portion Nf and is held in the transfer nip portion Nt in the first and second jobs can be stored to perform a determination as described above. Specifically, in the case in which the current detected by the detection unit 19 in the first job and the current detected by the detection unit 19 in the second job are substantially the same values, the transfer mediums P used in the first and second jobs are likely to be substantially similar in type and state. Thus, in such a case, it can be determined that the transfer mediums P are substantially similar in type and state, and after the first job is ended, the voltage applied from the transfer power source 18 to the transfer roller 8 in the first job can be reflected in the second job.

In the present exemplary embodiment, when a plurality of jobs is executed, if it is determined that AC banding occurs in the first job, the voltage applied from the transfer power source 18 to the transfer roller 8 in the first job is reflected in the second job. This makes it unnecessary to determine whether AC banding occurs in the second job and, furthermore, reduces AC banding on the first to last transfer mediums P in the second job. The methods of determining whether the transfer mediums P are substantially similar in type and state can be used singly or in combination in the present exemplary embodiment.

While applications to a monochrome image forming apparatus are described in the above exemplary embodiments, the present disclosure is not limited to the above-described exemplary embodiments. An exemplary embodiment of the present disclosure is also applicable to any apparatus including a fixing unit and a transfer member configured to transfer a toner image from an image bearing member onto a transfer medium P. Specifically, as illustrated in FIG. 16, an exemplary embodiment of the present disclosure is also applicable to a color image forming apparatus to produce a similar advantage.

Figure 16:
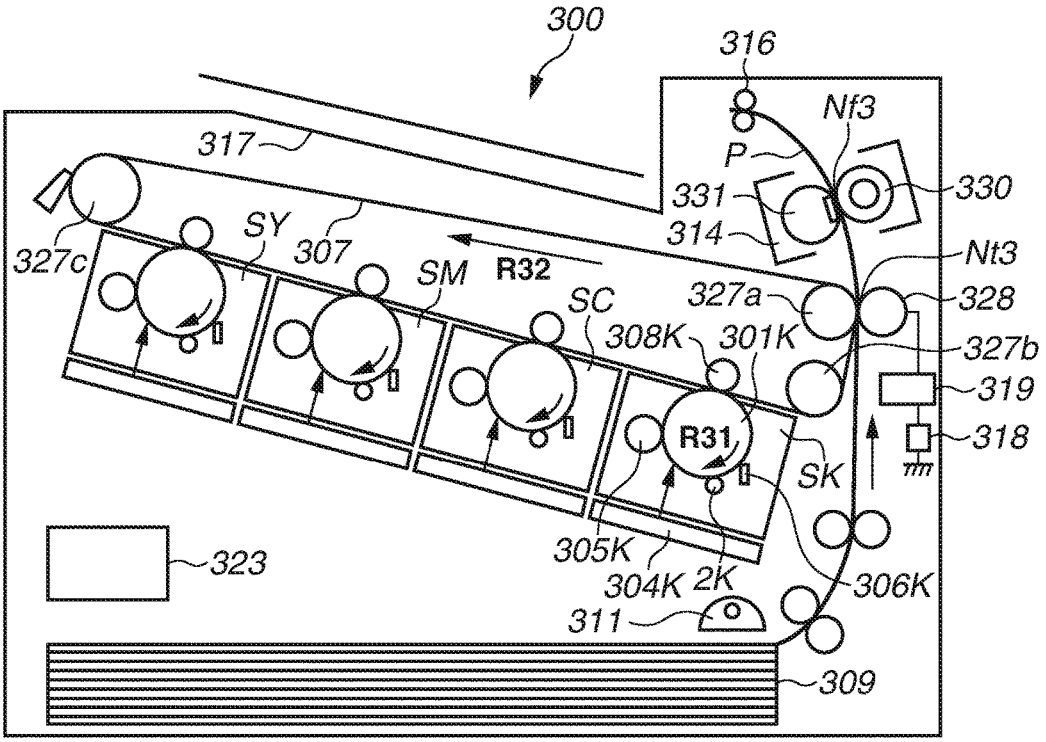
FIG. 16 is a cross sectional view schematically illustrating an image forming apparatus according to another exemplary embodiment of the subject disclosure.

FIG. 16 is a cross sectional view schematically illustrating an image forming apparatus 300 according to an exemplary embodiment of the present disclosure. As illustrated in FIG. 1, the image forming apparatus 100 according to the present exemplary embodiment is a color image forming apparatus in which image forming units SY, SM, SC, and SK configured to form yellow (Y), magenta (M), cyan (C), and black (K) images, respectively, are arranged at regular intervals. In the present exemplary embodiment, images formed by the image forming units SY, SM, SC, and SK are different in color, but the image forming units SY, SM, SC, and SK are substantially similar in structure and operation. Thus, the structure of the image forming apparatus 300 according to the present exemplary embodiment will be described below with reference to the image forming units SK.

In the image forming apparatus 300 according to the present exemplary embodiment, an image signal transmitted from an information device such as a personal computer (not illustrated) is received and analyzed in the image forming apparatus 300 and then transmitted to a control unit 323. Then, the control unit 323 controls various units based on information obtained by the analysis of the image signal so that the image forming apparatus 300 starts forming an image.

The image forming unit SK includes a photosensitive drum 301K which is a drum-shaped photosensitive member, a charging roller 302K which is a charging unit, a development roller 305K which is a development unit, and a cleaning unit 306K. When the image forming operation is started, the photosensitive drum 301K is driven and rotated in the direction of the arrow R1 in FIG. 16 at a predetermined circumferential speed, and during the rotation process, the photosensitive drum 301K is uniformly charged with a predetermined polarity (which is negative in the present exemplary embodiment) to a predetermined potential by the charging roller 302K. Thereafter, the photosensitive drum 301K is exposed by an exposure unit 304K based on the image signal to form an electrostatic latent image on the surface of the photosensitive drum 301K. The electrostatic latent image formed on the surface of the photosensitive drum 301K is developed with toner supplied from the development roller 305K to form a toner image on the photosensitive drum 301K.

An endless intermediate transfer belt 307 which is an image bearing member stretched around stretching rollers 327*a* to 327*c* which are a stretching member is situated to face the photosensitive drum 301K, and the intermediate transfer belt 307 is driven and rotated in the direction of an arrow R32 in FIG. 16. A primary transfer roller 308K is provided on the inner periphery of the intermediate transfer belt 307 to press the intermediate transfer belt 307 against the photosensitive drum 301K. Further, a primary transfer portion is formed in a position in which the intermediate transfer belt 307 pressed by the primary transfer roller 308K comes into contact with the photosensitive drum 301K. A toner image formed on the photosensitive drum 301K is primarily transferred from the photosensitive drum 301K onto the intermediate transfer belt 307 while passing through the primary transfer portion. In this way, toner images of the respective colors are primarily transferred from the image forming units SY, SM, SC, and SK onto the intermediate transfer belt 307 to form toner images of a plurality of colors corresponding to a target color image are formed on the intermediate transfer belt 307.

A secondary transfer roller 328 which is a transfer member is situated to face the stretching roller 327*a* via the intermediate transfer belt 307 which is an image bearing member, and a secondary transfer portion Nt3 which is a transfer portion is formed in the position in which the intermediate transfer belt 307 is in contact with the secondary transfer roller 328. The secondary transfer roller 328 is connected to a transfer power source 318, and the control unit 323 controls the transfer power source 318 to apply a voltage to the secondary transfer roller 328 so that the toner images of the plurality of colors are secondarily transferred from the intermediate transfer belt 307 onto the transfer medium P. Further, between the transfer power source 318 and the secondary transfer roller 328 is provided a detection unit 319 capable of detecting a current flowing in the secondary transfer roller 328.

The transfer medium P stacked in the sheet feeding cassette 9 is fed from the sheet feeding cassette 9 to the secondary transfer portion Nt3 by a sheet feeding roller 311 in synchronization with the timing at which the toner images of the plurality of colors formed on the intermediate transfer belt 307 reach the secondary transfer portion Nt3. The transfer medium P onto which the toner images of the plurality of colors are secondarily transferred in the secondary transfer portion Nt3 is conveyed to a fixing unit 314 and heated and pressed by a heating unit 331 and a pressing unit 330 to melt-mix and fix the toners of the respective colors to the transfer medium P. Thereafter, the transfer medium P is discharged to a sheet discharge tray 317 which is a sheet stacking unit by a sheet discharge roller 316.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Applications No. 2016-243807, filed Dec. 15, 2016, and No. 2016-251836, filed Dec. 26, 2016, which are hereby incorporated by reference herein in their entirety.

What is claimed is:

1. An image forming apparatus comprising:

an image bearing member configured to bear a toner image;

a transfer member configured to be brought into contact with the image bearing member to form a transfer portion and transfer the toner image from the image bearing member onto a transfer medium in the transfer portion;

a transfer power source configured to apply a voltage to the transfer member;

a fixing unit situated downstream of the transfer portion in a direction in which the transfer medium is conveyed, the fixing unit including a heating member and a pressing member configured to face the heating member to form the fixing portion, wherein the heating member includes a heating unit situated to face the transfer medium held in the fixing portion and a voltage is applied from an alternating-current power source to the heating unit so that the heating unit heats the transfer medium held in the fixing portion;

a first detection unit situated between the transfer member and the transfer power source and configured to detect a current flowing in the transfer member; and a control unit configured to control the transfer power source based on a first detection result input from the first detection unit, wherein the control unit determines a first voltage to be applied from the transfer power source to the transfer member in the case of transferring the toner image from the image bearing member onto the transfer medium in the transfer portion, based on a value of the voltage applied from the transfer power source to the transfer member when the control unit controls the transfer power source such that a current of a predetermined value flows to the transfer member while the transfer medium is not held in the transfer portion, and wherein in a case of transferring the toner image from the image bearing member onto the transfer medium in the transfer portion, the control unit controls the transfer power source based on a result of a comparison between a frequency obtained from the first detection result and a predetermined frequency range including a frequency of the alternating-current power source.

2. The image forming apparatus according to claim 1, wherein a point at which a gradient of a second waveform obtained by calculating a simple moving average of a first waveform obtained by calculating a simple moving average of the first detection result once is determined as a peak, and a frequency obtained from an interval between adjacent peaks is compared with the predetermined frequency range.

3. The image forming apparatus according to claim 2, wherein the adjacent peaks are a first peak at which the gradient of the second waveform changes from positive to negative and a second peak at which the gradient of the second waveform changes from negative to positive, and a frequency obtained from an interval between the first peak and the second peak is compared with the predetermined frequency range.

4. The image forming apparatus according to claim 3, wherein in a case in which a current value difference between the first peak and the second peak of the second waveform is equal to or larger than a predetermined value, the frequency obtained from the interval between the first peak and the second peak is compared with the predetermined frequency range.

5. The image forming apparatus according to claim 2, wherein in a case in which current value differences between adjacent peaks among at least three consecutive peaks of the second waveform are each equal to or larger than the predetermined value, frequencies obtained from intervals between the adjacent peaks are each compared with the predetermined frequency range.

6. The image forming apparatus according to claim 1, further comprising a second detection unit configured to detect a temperature or humidity of an environment surrounding the image forming apparatus, wherein in a case in which the frequency obtained from the first detection result is within the predetermined frequency range and the temperature or humidity detected by the second detection unit is equal to or higher than a predetermined value, the control unit changes, from the first voltage, the voltage to be applied from the transfer power source to the transfer member.

7. The image forming apparatus according to claim 6, wherein in a case in which the temperature or humidity detected by the second detection unit is lower than the predetermined value, the control unit does not change, from the first transfer voltage, the voltage to be applied from the transfer power source to the transfer member.

8. The image forming apparatus according to claim 1, further comprising a third detection unit configured to detect a voltage output from the alternating-current power source, wherein in a case in which the frequency obtained from the first detection result is within the predetermined frequency range and the voltage detected by the third detection unit is equal to or higher than a predetermined value, the control unit changes, from the first transfer voltage, the voltage to be applied from the transfer power source to the transfer member.

9. The image forming apparatus according to claim 1, wherein the control unit determines a type of a transfer medium to be conveyed to the transfer portion based on a print mode input to the control unit, and in a case in which the frequency obtained from the first detection result is within the predetermined frequency range, the control unit changes, from the first transfer voltage, the voltage to be applied from the transfer power source to the transfer member based on the type of the transfer medium which is obtained from the print mode.

10. The image forming apparatus according to claim 1, further comprising a fourth detection unit configured to detect a type of a transfer medium conveyed to the transfer portion, wherein in a case in which the frequency obtained from the first detection result is within the predetermined frequency range, the control unit changes, from the first transfer voltage, the voltage to be applied from the transfer power source to the transfer member based on the type of the transfer medium which is detected by the fourth detection unit.

11. The image forming apparatus according to claim 1, wherein the heating member includes a roll-shaped flexible member covering the heating unit, and the heating unit is situated to face the pressing member via the flexible member.

12. The image forming apparatus according to claim 11, wherein the flexible member is a conductive film.

13. The image forming apparatus according to claim 11, wherein the heating unit includes a substrate, an electrode portion to which the voltage from the alternating-current power source is applied, and a heat generation resistor formed on a surface of the substrate, and the application of the voltage from the alternating-current power source to the electrode portion passes a current in the heat generation resistor via the electrode portion to cause the heat generation resistor to generate heat, and the heat generation resistor generates heat so that the heating unit heats the transfer medium held in the fixing portion.

14. The image forming apparatus according to claim 13, wherein a bidirectional thyristor is situated between the electrode portion and the alternating-current power source, and the control unit controls a current flowing in the bidirectional thyristor to control the voltage to be applied from the alternating-current power source to the electrode portion.

15. The image forming apparatus according to claim 1, further comprising a development unit configured to supply a toner image to the image bearing member, wherein the image bearing member is a photosensitive member on which an electrostatic latent image is developed by the development unit.

16. An image forming apparatus comprising:

an image bearing member configured to bear a toner image;

a transfer member configured to be brought into contact with the image bearing member to form a transfer portion and transfer the toner image from the image bearing member onto a transfer medium in the transfer portion;

a transfer power source configured to apply a voltage to the transfer member;

a fixing unit situated downstream of the transfer portion in a direction in which the transfer medium is conveyed, the fixing unit including a heating member and a pressing member configured to face the heating member to form the fixing portion, wherein the heating member includes a heating unit situated to face the transfer medium held in the fixing portion and a voltage is applied from an alternating-current power source to the heating unit so that the heating unit heats the transfer medium held in the fixing portion;

a first detection unit situated between the transfer member and the transfer power source and configured to detect a current flowing in the transfer member; and a control unit configured to control the transfer power source based on a first detection result input from the first detection unit, wherein in a case of transferring the toner image from the image bearing member onto the transfer medium in the transfer portion, the control unit controls the transfer power source based on a result of a comparison between a frequency obtained from the first detection result and a predetermined frequency range including a frequency of the alternating-current power source, wherein a point at which a gradient of a second waveform obtained by calculating a simple moving average of a first waveform obtained by calculating a simple moving average of the first detection result once is determined as a peak, and a frequency obtained from an interval between adjacent peaks is compared with the predetermined frequency range.

17. The image forming apparatus according to claim 16, wherein the control unit determines a first voltage to be applied from the transfer power source to the transfer member in the case of transferring the toner image from the image bearing member onto the transfer medium in the transfer portion, based on a value of the voltage applied from the transfer power source to the transfer member when the control unit controls the transfer power source such that a current of a predetermined value flows to the transfer member while the transfer medium is not held in the transfer portion.

18. The image forming apparatus according to claim 16, wherein the adjacent peaks are a first peak at which the gradient of the second waveform changes from positive to negative and a second peak at which the gradient of the second waveform changes from negative to positive, and a frequency obtained from an interval between the first peak and the second peak is compared with the predetermined frequency range.

19. The image forming apparatus according to claim 18, wherein in a case in which a current value difference between the first peak and the second peak of the second waveform is equal to or larger than a predetermined value, the frequency obtained from the interval between the first peak and the second peak is compared with the predetermined frequency range.

20. The image forming apparatus according to claim 16, wherein in a case in which current value differences between adjacent peaks among at least three consecutive peaks of the second waveform are each equal to or larger than the predetermined value, frequencies obtained from intervals between the adjacent peaks are each compared with the predetermined frequency range.

21. The image forming apparatus according to claim 16, further comprising a second detection unit configured to detect a temperature or humidity of an environment surrounding the image forming apparatus, wherein in a case in which the frequency obtained from the first detection result is within the predetermined frequency range and the temperature or humidity detected by the second detection unit is equal to or higher than a predetermined value, the control unit changes, from the first voltage, the voltage to be applied from the transfer power source to the transfer member.

22. The image forming apparatus according to claim 21, wherein in a case in which the temperature or humidity detected by the second detection unit is lower than the predetermined value, the control unit does not change, from the first transfer voltage, the voltage to be applied from the transfer power source to the transfer member.

23. The image forming apparatus according to claim 16, further comprising a third detection unit configured to detect a voltage output from the alternating-current power source, wherein in a case in which the frequency obtained from the first detection result is within the predetermined frequency range and the voltage detected by the third detection unit is equal to or higher than a predetermined value, the control unit changes, from the first transfer voltage, the voltage to be applied from the transfer power source to the transfer member.

24. The image forming apparatus according to claim 16, wherein the control unit determines a type of a transfer medium to be conveyed to the transfer portion based on a print mode input to the control unit, and in a case in which the frequency obtained from the first detection result is within the predetermined frequency range, the control unit changes, from the first transfer voltage, the voltage to be applied from the transfer power source to the transfer member based on the type of the transfer medium which is obtained from the print mode.

25. The image forming apparatus according to claim 16, further comprising a fourth detection unit configured to detect a type of a transfer medium conveyed to the transfer portion, wherein in a case in which the frequency obtained from the first detection result is within the predetermined frequency range, the control unit changes, from the first transfer voltage, the voltage to be applied from the transfer power source to the transfer member based on the type of the transfer medium which is detected by the fourth detection unit.

26. The image forming apparatus according to claim 16, wherein the heating member includes a roll-shaped flexible member covering the heating unit, and the heating unit is situated to face the pressing member via the flexible member.

27. The image forming apparatus according to claim 26, wherein the flexible member is a conductive film.

28. The image forming apparatus according to claim 26, wherein the heating unit includes a substrate, an electrode portion to which the voltage from the alternating-current power source is applied, and a heat generation resistor formed on a surface of the substrate, and the application of the voltage from the alternating-current power source to the electrode portion passes a current in the heat generation resistor via the electrode portion to cause the heat generation resistor to generate heat, and the heat generation resistor generates heat so that the heating unit heats the transfer medium held in the fixing portion.

29. The image forming apparatus according to claim 28, wherein a bidirectional thyristor is situated between the electrode portion and the alternating-current power source, and the control unit controls a current flowing in the bidirectional thyristor to control the voltage to be applied from the alternating-current power source to the electrode portion.

30. The image forming apparatus according to claim 16, further comprising a development unit configured to supply a toner image to the image bearing member, wherein the image bearing member is a photosensitive member on which an electrostatic latent image is developed by the development unit.

* * * * *